US007177569B2

(12) United States Patent
Kamimura

(10) Patent No.: US 7,177,569 B2
(45) Date of Patent: Feb. 13, 2007

(54) IMAGE FORMING APPARATUS

(75) Inventor: Naoya Kamimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/798,401

(22) Filed: Mar. 12, 2004

(65) Prior Publication Data

US 2004/0228656 A1 Nov. 18, 2004

(30) Foreign Application Priority Data

Mar. 12, 2003 (JP) ..... 2003-067064

(51) Int. Cl.
*G03G 15/30* (2006.01)

(52) U.S. Cl. ..... 399/149

(58) Field of Classification Search ..... 399/149, 399/101, 150, 297, 299, 303
See application file for complete search history.

(56) References Cited

U.S. PATENT DOCUMENTS

| | | | | |
|---|---|---|---|---|
| 5,066,989 | A * | 11/1991 | Yamamoto | 399/149 |
| 5,363,178 | A | 11/1994 | Matsumoto | |
| 5,724,633 | A | 3/1998 | Amemiya | |
| 6,385,428 | B1 | 5/2002 | Uchida et al. | |
| 6,442,356 | B2 * | 8/2002 | Omata et al. | 399/66 |
| 6,708,011 | B2 * | 3/2004 | Nomura et al. | 399/110 |
| 6,721,524 | B2 * | 4/2004 | Sato et al. | 399/223 |
| 6,783,906 | B2 * | 8/2004 | Ishida et al. | 430/107.1 |
| 6,798,430 | B2 | 9/2004 | Sato | |
| 6,865,361 | B2 * | 3/2005 | Abe et al. | 399/302 |
| 6,904,256 | B2 * | 6/2005 | Sato et al. | 399/324 |
| 2003/0142988 | A1 | 7/2003 | Kimura | |

FOREIGN PATENT DOCUMENTS

| | | |
|---|---|---|
| JP | A 2-269373 | 2/1990 |
| JP | A 9-34205 | 7/1997 |
| JP | A 2000-29365 | 1/2000 |
| JP | A 2001-75331 | 3/2001 |
| JP | A 2001-117424 | 4/2001 |
| JP | A 2001-142279 | 5/2001 |
| JP | A 2001-147632 | 5/2001 |
| JP | A 2001-272833 | 10/2001 |
| JP | A 2002-189335 | 7/2002 |
| JP | A 2002-296840 | 9/2002 |
| JP | A 2003-295542 | 10/2003 |

* cited by examiner

*Primary Examiner*—Diego Gutierrez
*Assistant Examiner*—Dixomara Vargas
(74) *Attorney, Agent, or Firm*—Oliff & Berridge, PLC

(57) ABSTRACT

An image forming apparatus includes: an endless belt; a plurality of image carriers; a plurality of charging units; an exposing unit; and a plurality of developing units configured to develop an electrostatic latent image on each of the image carrier with a developer of different color to form a developer image and to retrieve a residual developer on the image carrier, wherein the endless belt is configured to be transferred the developer images formed on each of the plurality of image carriers thereon to form a color image, and transfers the color image onto a recording medium, and wherein the developing unit provided at a most upstream position with respect to the moving direction of the endless belt forms the developer image with a developer of black color, and is configured to retrieve a residual developer on the endless belt.

23 Claims, 14 Drawing Sheets

IMAGE FORMING APPARATUS

BACKGROUND OF THE INVENTION

1. Field of the Invention

The present invention relates to an image forming apparatus of a tandem type.

2. Description of the Related Art

Conventionally, an image forming apparatus of a tandem type has been well known in which toner images of different print colors are transferred in succession using a plurality of image carriers.

For example, in JP-A-2001-272833, an image forming apparatus is disclosed in which the toner images transferred on an intermediate transfer belt are transferred onto a sheet, a residual toner on the intermediate transfer belt is charged, moved to a photosensitive drum and retrieved from the intermediate transfer belt, and the residual toner moved onto the photosensitive drum is scraped by a blade in contact with the surface of the photosensitive drum and collected as a waste toner in a special container (see pages 5 through 11, and FIG. 11 of JP-A-2001-272833).

SUMMARY OF THE INVENTION

However, in the structure of the conventional image forming apparatus as described above, a special container for storing the waste toner is need to be provided. As a result, there is a problem that the size of apparatus is increased.

The present invention has been achieved in the light of the above-mentioned problem, and it is an object of one aspect of the present invention to provide an image forming apparatus of a tandem type having a smaller size.

In order to achieve the above object, according to a first aspect of the invention, there is provided an image forming apparatus including: an endless belt configured to be rotatably driven; a plurality of image carriers disposed in a moving direction of the endless belt; a plurality of charging units provided for each of the plurality of image carriers respectively and configured to uniformly charge a surface of each of the image carrier; an exposing unit configured to expose the plurality of image carriers charged by the charging unit to form an electrostatic latent image on the plurality of image carriers; and a plurality of developing units provided for each of the plurality of image carriers respectively and configured to develop the electrostatic latent image on each of the image carrier with a developer of different color to form a developer image and to retrieve a residual developer on the image carrier, wherein the endless belt is configured to be transferred the developer images formed on each of the plurality of image carriers thereon to form a color image, and transfers the color image onto a recording medium, and wherein the developing unit provided at a most upstream position with respect to the moving direction of the endless belt forms the developer image with a developer of black color, and is configured to retrieve a residual developer on the endless belt.

According to a second aspect of the invention, there is provided an image forming apparatus including: an endless belt configured to be rotatably driven and conveys a recording medium; a plurality of image carriers disposed in a moving direction of the endless belt; a plurality of charging units provided for each of the plurality of image carriers respectively and configured to uniformly charge a surface of each of the image carrier; an exposing unit configured to expose the plurality of image carriers charged by the charging unit to form an electrostatic latent image on the plurality of image carriers; and a plurality of developing units provided for each of the plurality of image carriers respectively and configured to develop the electrostatic latent image on each of the image carrier with a developer of different color to form a developer image and to retrieve a residual developer on the image carrier, wherein each of the plurality of image carriers transfer the developer images on the recording medium to form a color image, and wherein the developing unit provided at a most upstream position with respect to the moving direction of the endless belt forms the developer image with a developer of black color, and is configured to retrieve a developer adhered on the endless belt.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of preferred embodiments of the invention.

Figure 1:
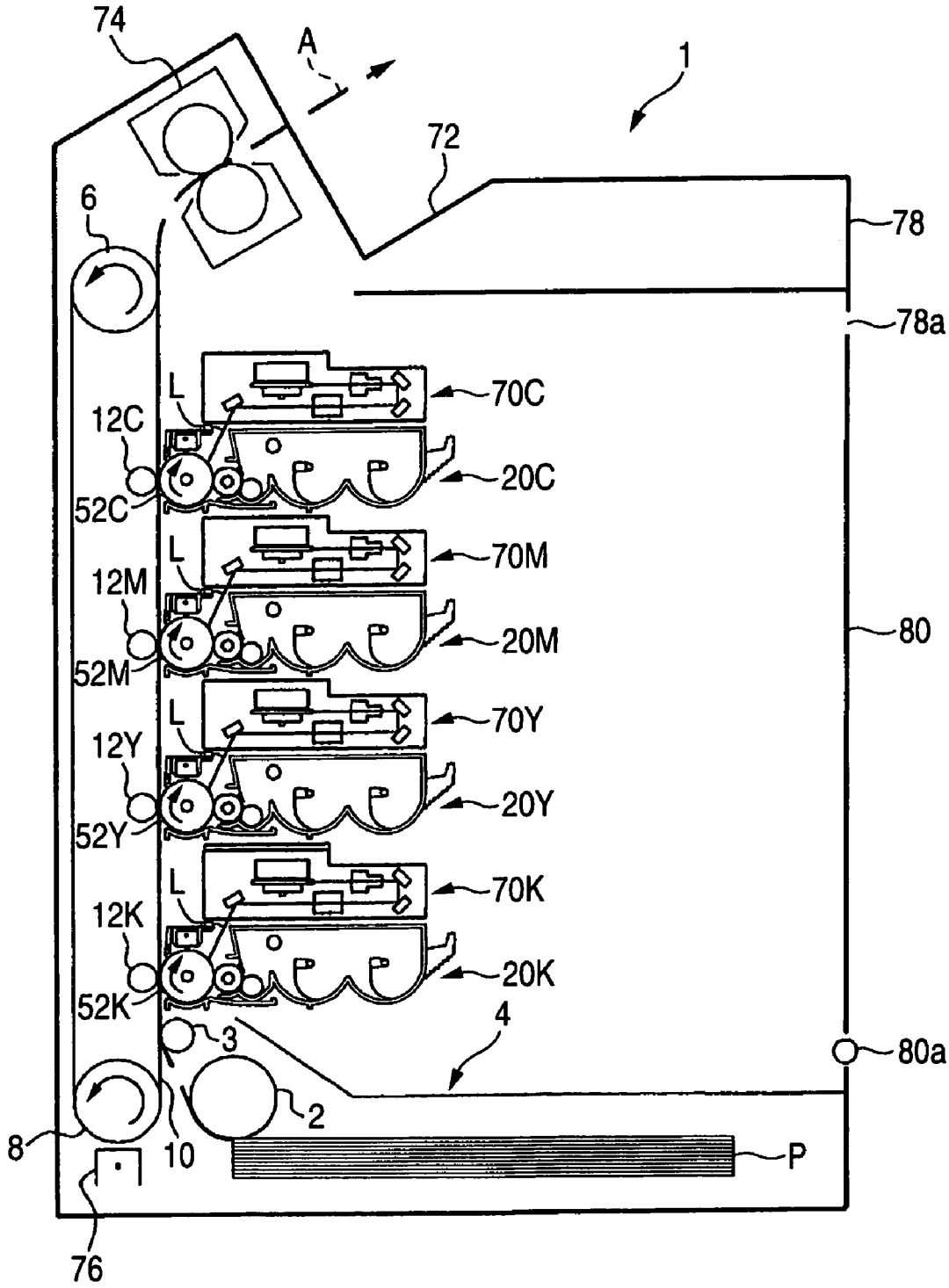
FIG. 1 is a schematic side cross-sectional view of a color laser printer according to a first embodiment of the present invention.

FIG. 1 is a schematic side cross-sectional view for explaining an internal structure of a color laser printer 1 as an image forming apparatus according to a first embodiment of the invention.

As shown in FIG. 1, the color laser printer 1 is of a tandem type, and includes a sheet feeding portion 4 for supplying the sheet P as the recording medium one by one with a sheet feed roller 2 and a conveying roller 3, a sheet conveying belt 10 in which looped over a driving roller 6 and a driven roller 8 for conveying the sheet P supplied from the sheet feeding portion 4 in a vertical upper direction, four transfer rollers 12K, 12Y, 12M and 12C, four process cartridges 20K, 20Y, 20M and 20C, and four laser scanner units 70K, 70Y, 70M and 70C, which are provided along a direction conveying the sheet P by the sheet conveying belt 10, for transferring the toner image corresponding to each print color of black (K), yellow (Y), magenta (M) and cyan (C) onto the sheet P, a fixing unit 74 for fixing the toner image transferred onto the sheet P and discharging the sheet to a sheet discharging portion 72, a belt charger 76 for charging the residual toner on the sheet conveying belt 10, a main body cover 78 for storing each unit or portion to form an appearance of the printer 1, and a closing door 80 for opening or closing an opening portion 78*a* by rotation around a rotation axis 80*a*, the closing door 80 provided on a front face of the main body cover 78 (on the right side in FIG. 1).

Referring to FIGS. 2 through 5, a structure of the process cartridges 20K, 20Y, 20M and 20C will be described. Because the four process cartridges 20K, 20Y, 20M and 20C have the same structure, common figures are employed.

Figure 2:
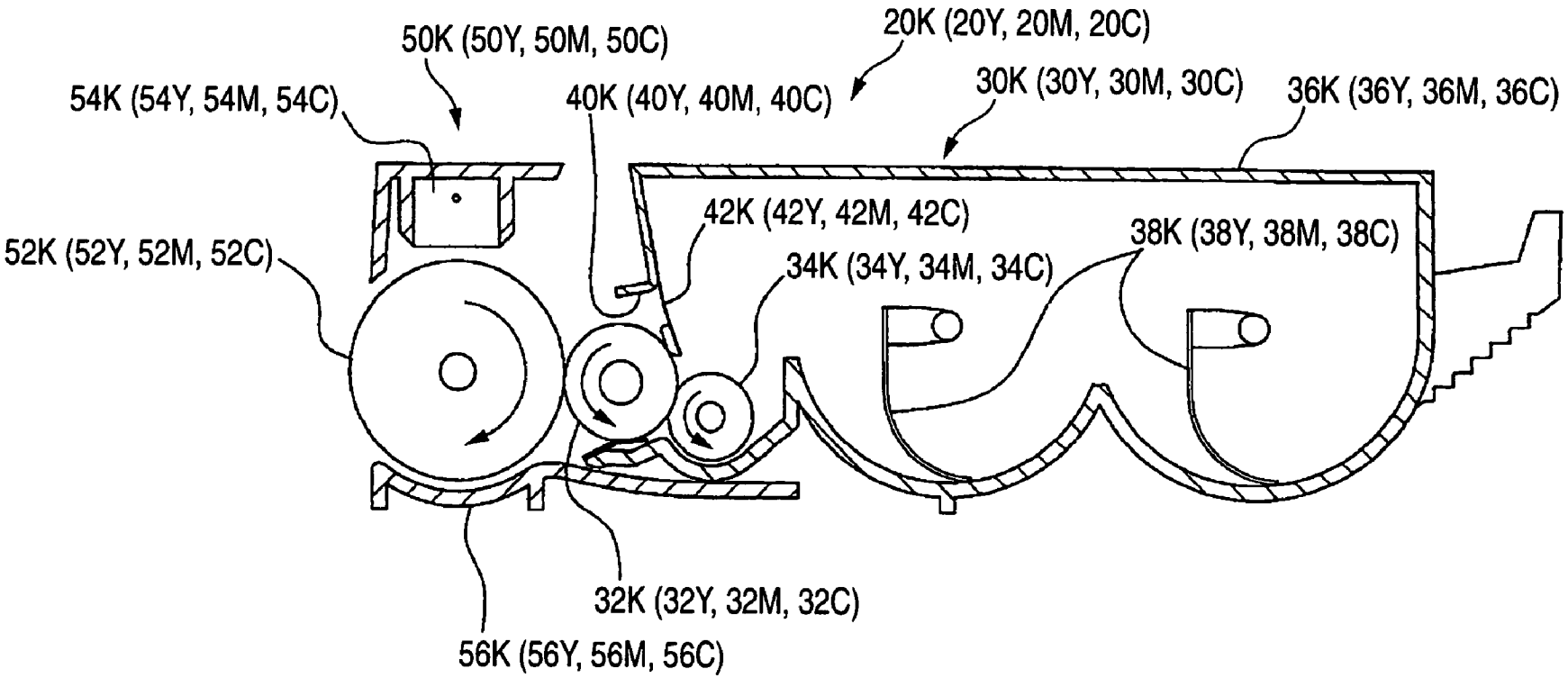
FIG. 2 is a schematic side cross-sectional view of a process cartridge.

As shown in FIG. 2, each process cartridge 20K, 20Y, 20M and 20C is composed of a developing unit 30K, 30Y, 30M and 30C and a drum unit 50K, 50Y, 50 and 50C.

Each housing 36K, 36Y, 36M and 36C is filled with a positively charged toner of non-magnetic one component as the developer. The toner is polymerized toner produced by copolymerizing polymeric monomer, for example, a styrene monomer such as styrene, or an acrylic monomer such as acrylic acid, alkyl (C1 to C4) acrylate, alkyl (C1 to C4) methacrylate by a well-known polymerizing method such as suspension polymerization. The polymerized toner is spherical, and has very excellent fluidity, whereby the high quality image is produced. Also, the housing 36K is filled with a black (K) toner, the housing 36Y is filled with a yellow (Y) toner, the housing 36M is filled with a magenta (M) toner, and the housing 36C is filled with a cyan (C) toner. The black (K) toner contains more charge control agent (CCA) than the other color (Y, M, C) toners, and has a higher charging ability (more chargeable) than the other color toners. Each housing 36K, 36Y, 36M and 36C is provided with an agitator 38K, 38Y, 38M and 38C to agitate the toner within the housing 36K, 36Y, 36M and 36C.

The supply roller 34K, 34Y, 34M and 34C is provided in an opening portion 40K, 40Y, 40M 40C formed at a side position of the housing 36K, 36Y, 36M and 36C, and driven for rotation in the arrow direction (counterclockwise direction in FIG. 2) by a drive motor, not shown.

The developing roller 32K, 32Y, 32M and 32C is provided in the opening portion 40K, 40Y, 40M and 40C of the housing 36K, 36Y, 36M and 36C in a state where it is in contact with the supply roller 34K, 34Y, 34M and 34C, and driven for rotation in the arrow direction (counterclockwise direction in FIG. 2) by a drive motor, not shown. That is, the developing roller 32K, 32Y, 32M and 32C and the supply roller 34K, 34Y, 34M and 34C are rotated in the same direction, and moved in opposite directions at a contact portion. Also, the peripheral speed of the developing roller 32K, 32Y, 32M and 32C is faster (1.6 times faster in this embodiment) than the peripheral speed of the photosensitive drum 52K, 52Y, 52M and 52C. A developing bias is applied to the developing roller 32K, 32Y, 32M and 32C by a developing bias applying circuit 98 (see FIG. 6).

A layer thickness regulating blade 42K, 42Y, 42M and 42C pressed on the developing roller 32K, 32Y, 32M and 32C is provided in the opening portion 40K, 40Y, 40M and 40C of the housing 36K, 36Y, 36M and 36C.

In the developing unit 30K, 30Y, 30M and 30C of this structure, the toner within the housing 36K, 36Y, 36M and 36C is supplied to the developing roller 32K, 32Y, 32M and 32C by rotation of the supply roller 34K, 34Y, 34M and 34C, and frictionally charged positively between the supply roller 34K, 34Y, 34M and 34C and the developing roller 32K, 32Y, 32M and 32C. Moreover, the toner supplied onto the developing roller 32K, 32Y, 32M and 32C enters between the layer thickness regulating blade 42K, 42Y, 42M and 42C and the developing roller 32K, 32Y, 32M and 32C along with the rotation of the developing roller 32K, 32Y, 32M and 32C, further frictionally charged there, and carried as a thin film of fixed thickness on the developing roller 32K, 32Y, 32M and 32C.

On the other hand, the drum unit 50K, 50Y, 50M and 50C comprises the photosensitive drum 52K, 52Y, 52M and 52C, the charger 54K, 54Y, 54M and 54C, and a frame member 56K, 56Y, 56M and 56C for supporting the photosensitive drum and charger integrally.

Each photosensitive drum 52K, 52Y, 52M and 52C is an electrophotosensitive drum in which an organic photoconductive layer (OPC photoconductor) is coated on the circumferential face of a drum main body. And the photosensitive drum 52K, 52Y, 52M and 52C, with its central axis (axis perpendicular to the sheet face in FIG. 2) supported by the frame member 56K, 56Y, 56M and 56C, is provided to be able to contact with the developing roller 32K, 32Y, 32M and 32C, and driven for rotation in the arrow direction (clockwise direction in FIG. 2) by a drive motor, not shown.

The charger 54K, 54Y, 54M and 54C is supported with a certain gap apart by the frame member 56K, 56Y, 56M and 56C to be out of contact with the photosensitive drum 52K, 52Y, 52M and 52C. The charger 54K, 54Y, 54M and 54C is a Scorotron type for positive charge of producing a corona discharge from a charging wire made of tungsten, and uniformly charges in positive polarity the surface of the photosensitive drum 52K, 52Y, 52M and 52C. A charge bias is applied to the charger 54K, 54Y, 54M and 54C by a charge bias applying circuit 96 (see FIG. 6).

The process cartridge 20K, 20Y, 20M and 20C is mounted or demounted via the opening portion 78*a* of the main body cover 78 on or from the color laser printer 1 in a state where the closing door 80 is opened. In the process cartridge 20K, 20Y, 20M and 20C, the developing unit 30K, 30Y, 30M and 30C is removably mounted from the drum unit 50K, 50Y, 50M and 50C.

Figure 3:
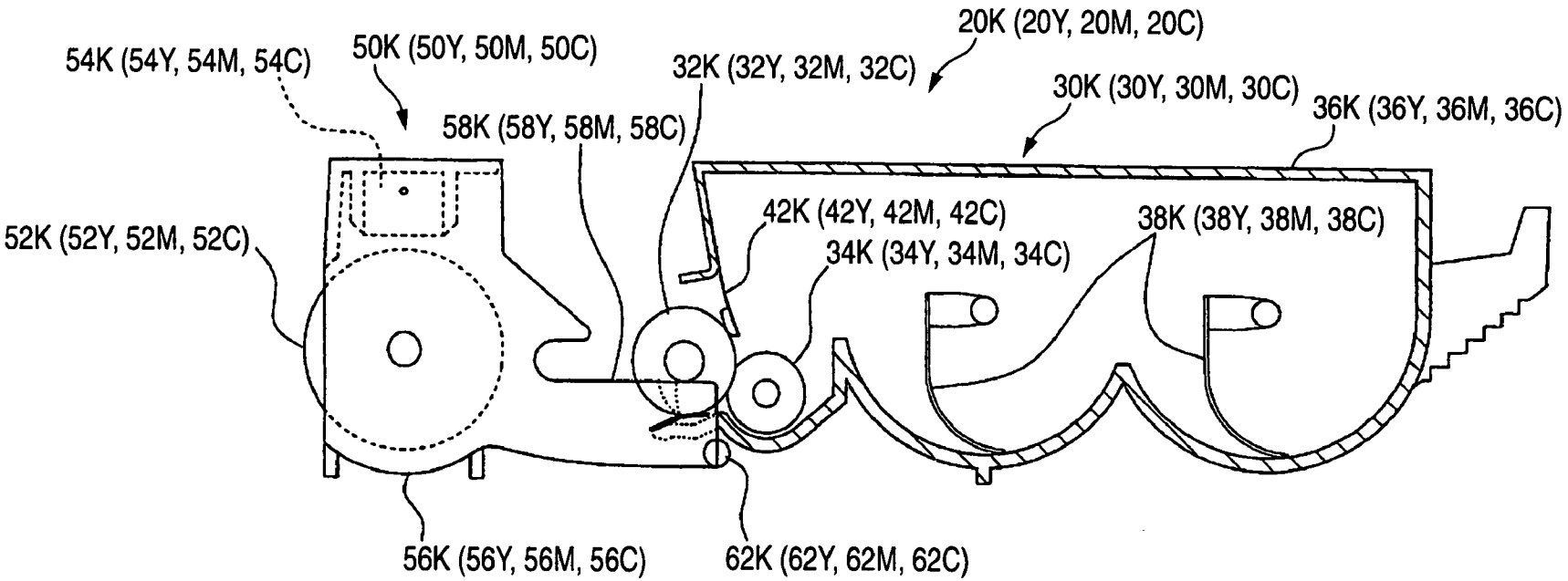
FIG. 3 is an explanatory view for explaining a separation mechanism for the process cartridge.

That is, the frame member 56K, 56Y, 56M and 56C of the drum unit 50K, 50Y, 50M and 50C is formed with a developing unit guide 58K, 58Y, 58M and 58C for guiding the central axis of the developing roller 32K, 32Y, 32M and 32C in the developing unit 30K, 30Y, 30M and 30C, whereby the developing unit 30K, 30Y, 30M and 30C is slidable in the direction to or out of the drum unit 50K, 50Y, 50M and 50C, as shown in FIG. 3.

Figure 4A:
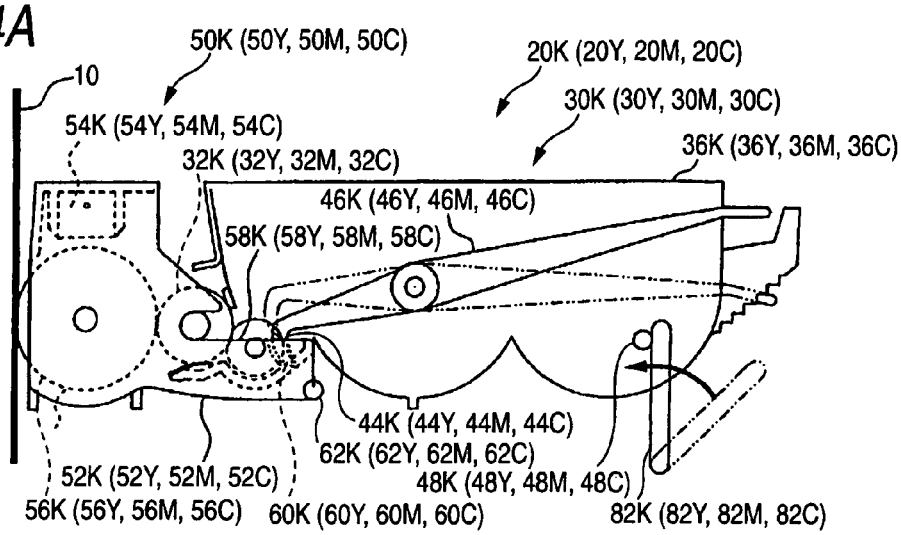
FIGS. 4A through 4C are explanatory views for explaining an operation of mounting or demounting the process cartridge.

A connection lever 46K, 46Y, 46M and 46C with an engaging pawl 44K, 44Y, 44M and 44C formed at the tip is axially supported on the side face of the housing 36K, 36Y, 36M and 36C for the developing unit 30K, 30Y, 30M and 30C, as shown in FIG. 4A. The connection lever 46K, 46Y, 46M and 46C is urged by a spring, not shown, so that the engaging pawl 44K, 44Y, 44M and 44C may be moved downwards. In FIG. 4, the connection lever 46K, 46Y, 46M and 46C is urged to be rotated in the counterclockwise direction. On the other hand, the developing unit guide 58K, 58Y, 58M and 58C in the frame member 56K, 56Y, 56M and 56C of the drum unit 50K, 50Y, 50M and 50C is formed with an engagement hole 60K, 60Y, 60M and 60C engaged by the engaging pawl 44K, 44Y, 44M and 44C of the connection lever 46K, 46Y, 46M and 46C.

Figure 4B:
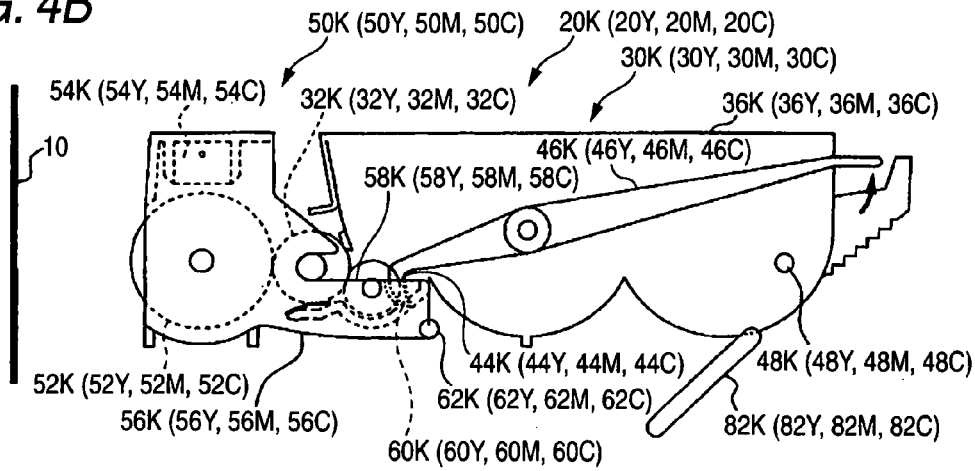

Therefore, in a state where the developing unit 30K, 30Y, 30M and 30C is contacted against the drum unit 50K, 50Y, 50M and 50C along the developing unit guide 58K, 58Y, 58M and 58C, so that a grip of the connection lever 46K, 46Y, 46M and 46C is raised as shown in FIG. 4B, the engaging pawl 44K, 44Y, 44M and 44C of the connection lever 46K, 46Y, 46M and 46C engages the engagement hole 60K, 60Y, 60M and 60C, so that the developing unit 30K, 30Y, 30M and 30C is held inseparable from the drum unit 50K, 50Y, 50M and 50C. Thereby, the process cartridge 20K, 20Y, 20M and 20C is mounted or demounted integrally.

Figure 4C:
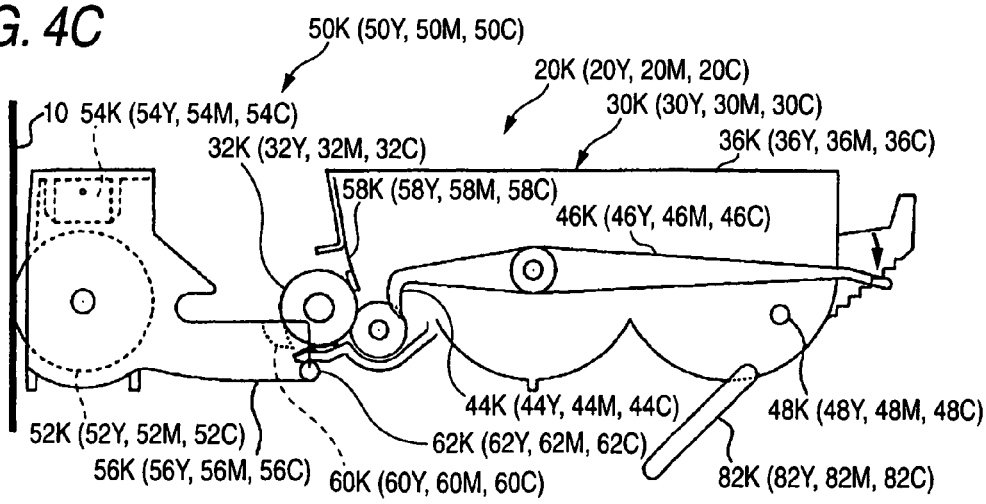

When the grip of the connection lever 46K, 46Y, 46M and 46C is lowered against a biasing force of the spring, the engaging pawl 44K, 44Y, 44M and 44C of the connection lever 46K, 46Y, 46M and 46C gets out of engagement with the engagement hole 60K, 60Y, 60M and 60C. In this state, when the developing unit 30K, 30Y, 30M and 30C is drawn, the developing unit 30K, 30Y, 30M and 30C is separated from the drum unit 50K, 50Y, 50M and 50C, as shown in FIG. 4C. Thereby, the developing unit 30K, 30Y, 30M and 30C is mounted or demounted individually from the drum unit 50K, 50Y, 50M and 50C.

A projection portion 48K, 48Y, 48M and 48C is formed on the side face of the housing 36K, 36Y, 36M and 36C of the developing unit 30K, 30Y, 30M and 30C. A pressing member 82K, 82Y, 82M and 82C for pressing the projection portion 48K, 48Y, 48M and 48C to urge the developing unit 30K, 30Y, 30M and 30C toward the drum unit 50K, 50Y, 50M and 50C is provided on the main body side. In a state where the developing unit 30K, 30Y, 30M and 30C is not mounted in the color laser printer 1, the pressing member 82K, 82Y, 82M and 82C is located at a lower position (indicated by the two-dot chain line in FIG. 4A) where it is out of contact with the projection portion 48K, 48Y, 48M and 48C in mounting the developing unit 30K, 30Y, 30M and 30C. Along with the mounting operation of the developing unit 30K, 30Y, 30M and 30C, the pressing member is rotated upwards. And in a state where the developing unit 30K, 30Y, 30M and 30C is mounted (FIG. 4A), the pressing member 82K, 82Y, 82M and 82C presses the projection portion 48K, 48Y, 48M and 48C for the developing unit 30K, 30Y, 30M and 30C by a spring force, whereby the developing unit 32K, 32Y, 32M and 32C and the photosensitive drum 52K, 52Y, 52M and 52C are kept in contact under a certain contact pressure.

Figure 5:
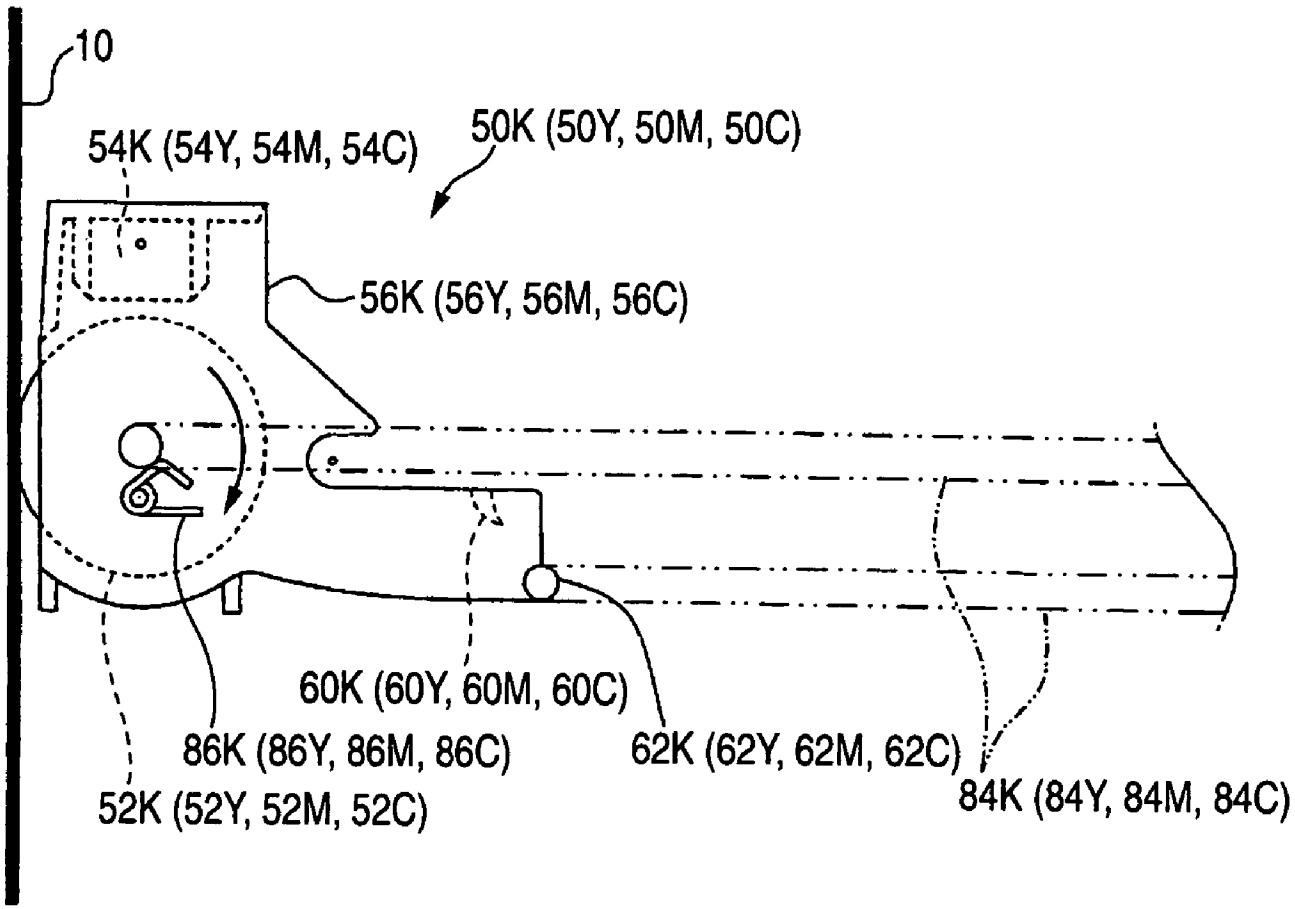
FIG. 5 is an explanatory view for explaining an operation of mounting or demounting a drum unit.

On either side of the drum unit 50K, 50Y, 50M and 50C (in the direction of the central axis of the photosensitive drum 52K, 52Y, 52M and 52C), a drum unit guide 84K, 84Y, 84M and 84C for assisting with the mounting or demounting operation of the drum unit 50K, 50Y, 50M and 50C is provided on the main body frame, as shown in FIG. 5.

The drum unit guide 84K, 84Y, 84M and 84C is formed with two grooves extending in the horizontal direction on a member formed in a plate-like shape, in which an upper groove guides the rotation axis of the photosensitive drum 52K, 52Y, 52M and 52C in the drum unit 50K, 50Y, 50M and 50C and a lower groove guides the projection portion 62K, 62Y, 62M and 62C provided on the frame member 56K, 56Y, 56M and 56C. Therefore, the drum unit 50K, 50Y, 50M and 50C is inserted at a fixed orientation into the color laser printer 1 by the drum unit guide 84K, 84Y, 84M and 84C, in which the movable position in the insertion direction is restricted.

At an end portion of the upper groove in the drum unit guide 84K, 84Y, 84M and 84C, a positioning spring 86K, 86Y, 86M and 86C for securing the rotation axis of the photosensitive drum 52K, 52Y, 52M and 52C to the end portion of the groove is provided to secure the drum unit 50K, 50Y, 50M and 50C at a stationary position.

The process cartridge 20K, 20Y, 20M and 20C is structured as described above.

A laser scanner unit 70K, 70Y, 70M and 70C applies a laser beam L to the photosensitive drum 52K, 52Y, 52M and 52C of the corresponding process cartridge 20K, 20Y, 20M and 20C, and scans the laser beam L along the direction of the rotation axis of the photosensitive drum 52K, 52Y, 52M and 52C, as shown in FIG. 1. In the laser scanner unit 70K, 70Y, 70M and 70C, exposure is controlled by an exposure control applying circuit 102 (see FIG. 6).

The transfer roller 12K, 12Y, 12M and 12C is provided opposite to the photosensitive drum 52K, 52Y, 52M and 52C, and rotatably supported. The transfer roller 12K, 12Y, 12M and 12C has a roller made of conductive rubber material covered around a roller shaft made of metal and is rotated following the driving of the photosensitive drum 52K, 52Y, 52M and 52C. A transfer bias is applied to the transfer roller 12K, 12Y, 12M and 12C by a transfer bias applying circuit 100 (see FIG. 6).

The belt charger 76 is supported with a certain gap on the main body frame to be out of contact with the sheet conveying belt 10. The belt charger 76, like the charger 54K, 54Y, 54M and 54C provided on the process cartridge 20K, 20Y, 20M and 20C, is of a Scorotron type and uniformly charges the toner adhering to the sheet conveying belt 10 in negative polarity. A charge bias is applied to the belt charger 76 by a belt charge bias applying circuit 106 (see FIG. 6).

An electrical configuration of the color laser printer 1 will be described hereinbelow.

Figure 6:
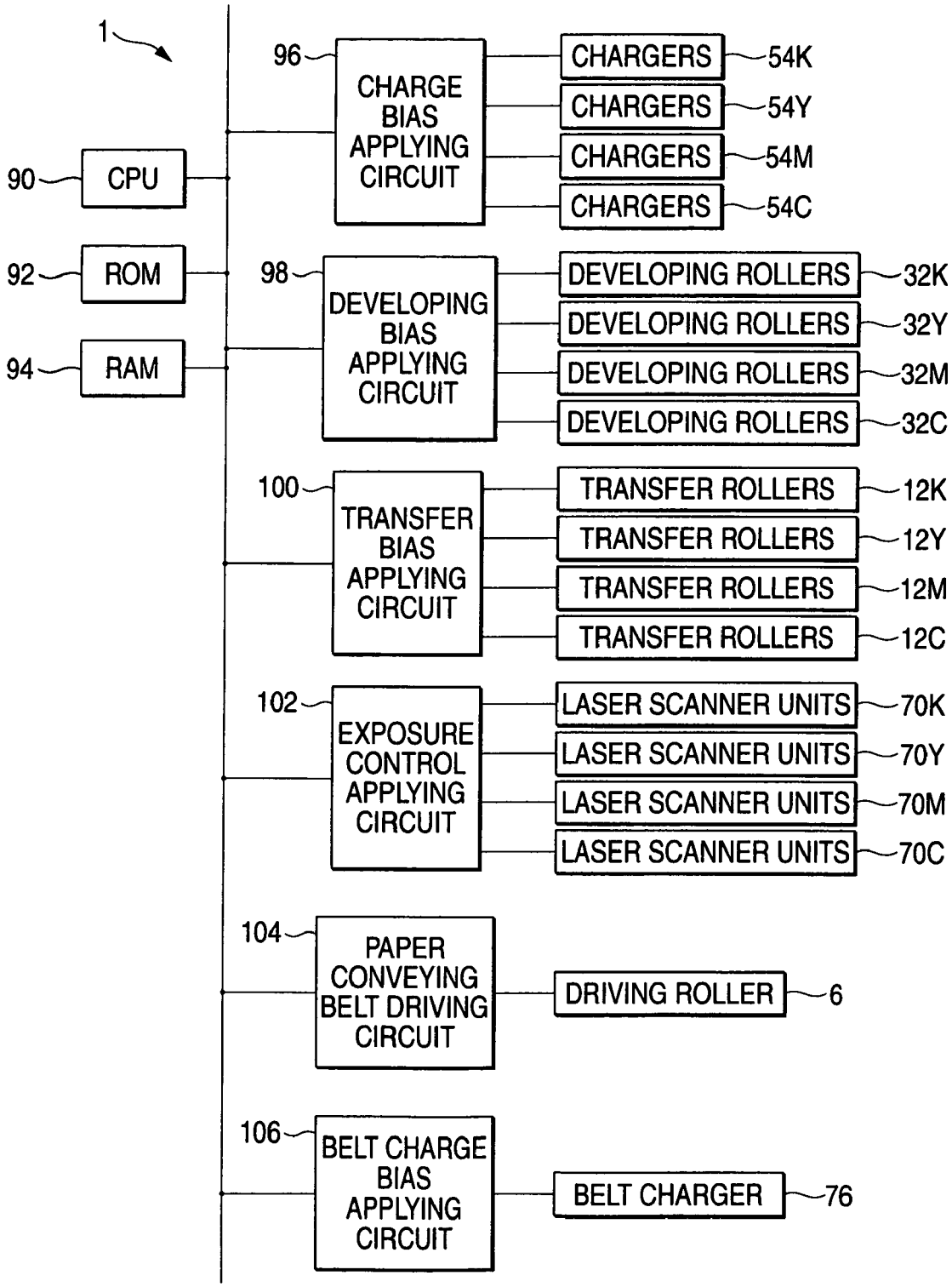
FIG. 6 is a block diagram representing an electrical configuration of the color laser printer according to the first embodiment.

As shown in FIG. 6, the color laser printer 1 includes a well-known CPU 90, ROM 92 and RAM 94, the chargers 54K, 54Y, 54M and 54C and the charge bias applying circuit 96 for applying a charge bias to the chargers, the developing rollers 32K, 32Y, 32M and 32C and the developing bias applying circuit 98 for applying a developing bias to the developing rollers, the transfer rollers 12K, 12Y, 12M and 12C and the transfer bias applying circuit 100 for applying a transfer bias to the transfer rollers, the laser scanner units 70K, 70Y, 70M and 70C and the exposure control applying circuit 102 for controlling the exposure for the laser scanner units, the driving roller 6 and a sheet conveying belt driving circuit 104 for driving for rotation the sheet conveying belt 10 by driving the driving roller 6, and the belt charger 76 and the belt charge bias applying circuit 106 for applying a charge bias to the belt charger 76.

An operation of the color laser printer 1 will be described hereinbelow.

[Printing Operation of Color Image on the Sheet P]

In the process cartridge 20K, 20Y, 20M and 20C, the surface of the photosensitive drum 52K, 52Y, 52M and 52C is uniformly charged in positive polarity by the charger 54K, 54Y, 54M and 54C to which a charge bias is applied by the charge bias applying circuit 96, along with the rotation of the photosensitive drum 52K, 52Y, 52M and 52C. And the surface of the photosensitive drum 52K, 52Y, 52M and 52C is exposed by fast scan of the laser beam L from the laser scanner unit 70K, 70Y, 70M and 70C under the control of the exposure control applying circuit 102, so that the potential at an exposed portion is decreased to form an electrostatic latent image for each print color.

Then, when the positively charged toner carried on the developing roller 32K, 32Y, 32M and 32C, to which a developing bias lower than at unexposed portion of the photosensitive drum and higher than at the exposed portion is applied by the developing bias applying circuit 98, is opposed to and contacted with the photosensitive drum 52K, 52Y, 52M and 52C, the toner is moved to an electrostatic latent image formed on the surface of the photosensitive drum 52K, 52Y, 52M and 52C, namely, an exposed portion exposed by laser beam L and having a lower potential among the uniformly, positively charged surface of the photosensitive drum 52K, 52Y, 52M and 52C, and selectively carried to form a toner image.

The sheet P is supplied from the sheet feeding portion 4 to the sheet conveying belt 10 driven for rotation by the sheet conveying belt driving circuit 104, conveyed upwards on the sheet conveying belt 10, and discharged via the fixing unit 74 into the sheet discharging portion 72, as indicated by the arrow A in FIG. 1. The moving speed of the sheet conveying belt 10, or the sheet conveying speed, is set to have a speed difference of about 1% from the peripheral speed of the photosensitive drum 52K, 52Y, 52M and 52C.

The toner image carried on the surface of the photosensitive drum 52K, 52Y, 52M and 52C is conveyed successively onto the sheet P, when the sheet P is conveyed between the photosensitive drum 52K, 52Y, 52M and 52C and the transfer roller 12K, 12Y, 12M and 12C, to which a transfer bias of reverse polarity (negative polarity) to that of the toner image on the photosensitive drum 52K, 52Y, 52M and 52C is applied by the transfer bias applying circuit 100 (image forming operation) Herein, the toner image for each color is formed with a slight time difference in accordance with the moving speed of the sheet conveying belt 10 and the distance between each photosensitive drum 52K, 52Y, 52M and 52C, and thereby transferred onto the sheet P to be superposed thereon to form a color image.

Thereafter, the toner image transferred onto the sheet P is fixed on the sheet P by the fixing unit 74, and the sheet P is discharged into the sheet discharging portion 72.

[Retrieval Operation of Residual Toner on the Photosensitive Drum 52K, 52Y, 52M and 52C]

Residual toner, the toner remaining on the photosensitive drum 52K, 52Y, 52M and 52C without being transferred onto the sheet P from the photosensitive drum 52K, 52Y, 52M and 52C, is retrieved into the housing 36K, 36Y, 36M and 36C by the developing roller 32K, 32Y, 32M and 32C. That is, after transfer, the photosensitive drum 52K, 52Y, 52M and 52C is exposed by laser beam L to form an electrostatic latent image, but the toner remaining on the unexposed portion on the surface of the photosensitive drum 52K, 52Y, 52M and 52C is electrically moved to the developing roller 32K, 32Y, 32M and 32C, scraped by the supply roller 34K, 34Y, 34M and 34C, and retrieved into the housing 36K, 36Y, 36M and 36C, whereby a so-called cleaningless system is employed. The residual toner and the toner migrated from the developing roller 32K, 32Y, 32M and 32C adhere to the exposed portion, and are transferred from the photosensitive drum 52K, 52Y, 52M and 52C onto the sheet P at the transfer position.

[Retrieval Operation of Toner Adhering to the Sheet Conveying Belt 10]

The toner from the photosensitive drum 52K, 52Y, 52M and 52C may adhere to the sheet conveying belt 10 that comes into direct contact with the photosensitive drum 52K, 52Y, 52M and 52C. The toner adhering to the sheet conveying belt 10 is uniformly charged negatively by the belt charger 76, to which a charge bias is applied by the belt charge bias applying circuit 106, and adsorbed (electrically moved) to the photosensitive drum 52K, when passing between the photosensitive drum 52K on the most upstream side in the conveyance direction of the sheet P and the transfer roller 12K to which a transfer bias of negative polarity is applied. Thereby, the toner is charged by the charger 54K as described above, and retrieved into the housing 36K by the developing roller 32K.

In the color laser printer 1, when it is determined that there is a large amount of toner adhering onto the sheet conveying belt 10, the operation mode of the printer 1 transits from a normal mode in which the toner adhering onto the sheet conveying belt 10 is retrieved during the printing of the image on the sheet P to a cleaning mode in which the toner adhering onto the sheet conveying belt 10 is retrieved without printing the image on the sheet P. More specifically, when a sheet jam occurs or when the power is suddenly cut off during the printing operation, and thereafter turned on again, the operation mode transits to the cleaning mode. When the transfer position alignment (calibration) of the toner image transferred by each photosensitive drum 52K, 52Y, 52M and 52C is made by transferring a pattern directly onto the sheet conveying belt 10 and reading a degree of dislocation by an optical sensor, the operation mode may transit to the cleaning mode after the aligning operation.

The cleaning mode is different from the normal mode in that the sheet P is not supplied from the sheet feeding portion 4 and the laser scanner unit 70K, 70Y, 70M and 70C does not emit a laser beam. By driving for rotation the sheet conveying belt 10 by one cycle in this cleaning mode, the toner adhering to the sheet conveying belt 10 is retrieved via the photosensitive drum 52K onto the developing unit 30K. Therefore, in the cleaning mode, the photosensitive drum 52K having the surface uniformly charged positively by the charger 54K makes contact with the sheet conveying belt 10 without the potential being decreased by exposure, and the toner adhering onto the sheet conveying belt 10 is effectively adsorbed to the photosensitive drum 52K.

In the color laser printer 1 of the first embodiment, the sheet conveying belt 10 functions as an endless belt, and the belt charger 76 functions as developer charging unit. Each photosensitive drum 52K, 52Y, 52M and 52C functions as an image carrier, each charger 54K, 54Y, 54M and 54C functions as charging unit, and the laser scanner unit 70K, 70Y, 70M and 70C functions as exposing unit. Each developing unit 30K, 30Y, 30M and 30C functions as developing unit, each developing roller 32K, 32Y, 32M and 32C functions as a developer carrier, and each supply roller 34K, 34Y, 34M and 34C functions as supplying means.

In the above way, the color laser printer 1 of the first embodiment has the following advantages (a) through (k).

(a) Since the residual toner after transfer on each photosensitive drum 52K, 52Y, 52M and 52C is retrieved into each developing unit 30K, 30Y, 30M and 30C, and the toner adhering to the sheet conveying belt 10 is also retrieved into the developing unit 30K, it is unnecessary to provide the container for collecting the waste toner. Consequently, the printer 1 is made smaller. Particularly, since the toner adhering to the sheet conveying belt 10 is passed from the sheet conveying belt 10 via the photosensitive drum 52K to the developing unit 30K, it is unnecessary to provide a special conveyance member for conveying the toner adhering to the sheet conveying belt 10 to the developing unit 30K, thereby preventing the apparatus from being increased in size.

(b) A large amount of toner adhering to the sheet conveying belt is securely retrieved in the cleaning mode.

(c) Since the charger 54K, 54Y, 54M and 54C is out of contact with the photosensitive drum 52K, 52Y, 52M and 52C, the toner adhering to an area past the transfer position in the photosensitive drum 52K, 52Y, 52M and 52C is prevented from adhering to the charger 54K, 54Y, 54M and 54C.

(d) Since the developing unit 30K, 30Y, 30M and 30C and the drum unit 50K, 50Y, 50M and 50C are provided to be separable, the drum unit 50K, 50Y, 50M and 50C is continually employed even when there is a need for exchanging the developing unit 30K, 30Y, 30M and 30C. Particularly, in a tandem type printer such as the printer 1 of the embodiment, it is required to superpose the toner image for each print color accurately, whereby the high precision (high cost) photosensitive drum 52K, 52Y, 52M and 52C is employed. Since the blade for scraping the residual toner on the photosensitive drum 52K, 52Y, 52M and 52C is not employed, the life of the photosensitive drum 52K, 52Y, 52M and 52C is lengthened, bringing about a great advantage that the developing unit 30K, 30Y, 30M and 30C and the drum unit 50K, 50Y, 50M and 50C are provided to be separable.

(e) Since the developing roller 32K, 32Y, 32M and 32C is in contact with the photosensitive drum 52K, 52Y, 52M and 52C, the toner adhering to an area past the transfer position in the photosensitive drum 52K, 52Y, 52M and 52C is retrieved efficiently. Moreover, since the peripheral speed of the developing roller 32K, 32Y, 32M and 32C and the peripheral speed of the photosensitive drum 52K, 52Y, 52M and 52C have a speed difference, the toner is retrieved efficiently from the photosensitive drum 52K, 52Y, 52M and 52C to the developing roller 32K, 32Y, 32M and 32C.

(f) Since the polymerized toner is usable as the toner, the toner is less likely to remain on the sheet conveying belt 10. Also, since the polymerized toner has excellent fluidity, it is easy to electrically move the toner on the sheet conveying belt 10. Therefore, the migration of the toner from the sheet conveying belt 10 to the photosensitive drum 52K, 52Y, 52M and 52C, and from the photosensitive drum 52K, 52Y, 52M and 52C to the developing roller 32K, 32Y, 32M and 32C occurs favorably, whereby the toner is easily retrieved in the developing roller 32K, 32Y, 32M and 32C.

(g) Since the toner adhering to the sheet conveying belt 10 is retrieved into the developing unit 30K filled with the black toner, and the black toner with a higher charging ability than the other color toners is preferentially employed, it is possible to extremely reduce the influence caused by a hue of the color image printed on the sheet P. In addition, since the supply roller 34K, 34Y, 34M and 34C is rotated in the opposite direction to the developing roller 32K, 32Y, 32M and 32C, the toner retrieved by the developing roller 32K, 32Y, 32M and 32C is scraped efficiently. Furthermore, the scraped toner is mixed into the toner filled within the housing 36K, 36Y, 36M and 36C and concealed.

(h) In the structure described in the prior art section (specifically, the structure described in JP-A-2001-272833), the waste toner container is provided only for the process cartridge corresponding to the black toner, and the process cartridge alone must have a different shape from the other process cartridges, resulting in a problem that the manufacturing cost is increased. However, in the color laser printer 1, because the waste toner container is unnecessary, and all the four process cartridges 20K, 20Y, 20M and 20C have the same shape, the above problem does not occur.

(i) In the structure described in the prior art section, the blade is contacted against the photosensitive drum corresponding to the black toner, which is required to be driven at a different rotation torque from the other photosensitive drums, and is difficult to make the same movement, resulting in a problem that the toner image is likely to cause a dislocation. However, in the color laser printer 1, since the blade is unnecessary, and four photosensitive drums 52K, 52Y, 52M and 52C are driven at the same rotation torque, the above problem does not occur.

(j) Since the moving speed of the sheet conveying belt 10 and the peripheral speed of the photosensitive drum 52K, 52Y, 52M and 52C have a speed difference, the toner is likely to move from the sheet conveying belt 10 to the photosensitive drum 52K, 52Y, 52M and 52C.

(k) The toner adhering to the sheet conveying belt 10 is retrieved even during the printing of the image on the sheet P. Also, with this structure, when the sheet conveying belt 10 is driven at the initial operation of turning on the power, or before or after exposure with the laser scanner unit 70K, 70Y, 70M and 70C for the printing operation, the toner is removed from the sheet conveying belt 10, whereby the start-up time required to be ready for the printing operation is shortened.

Figure 7:
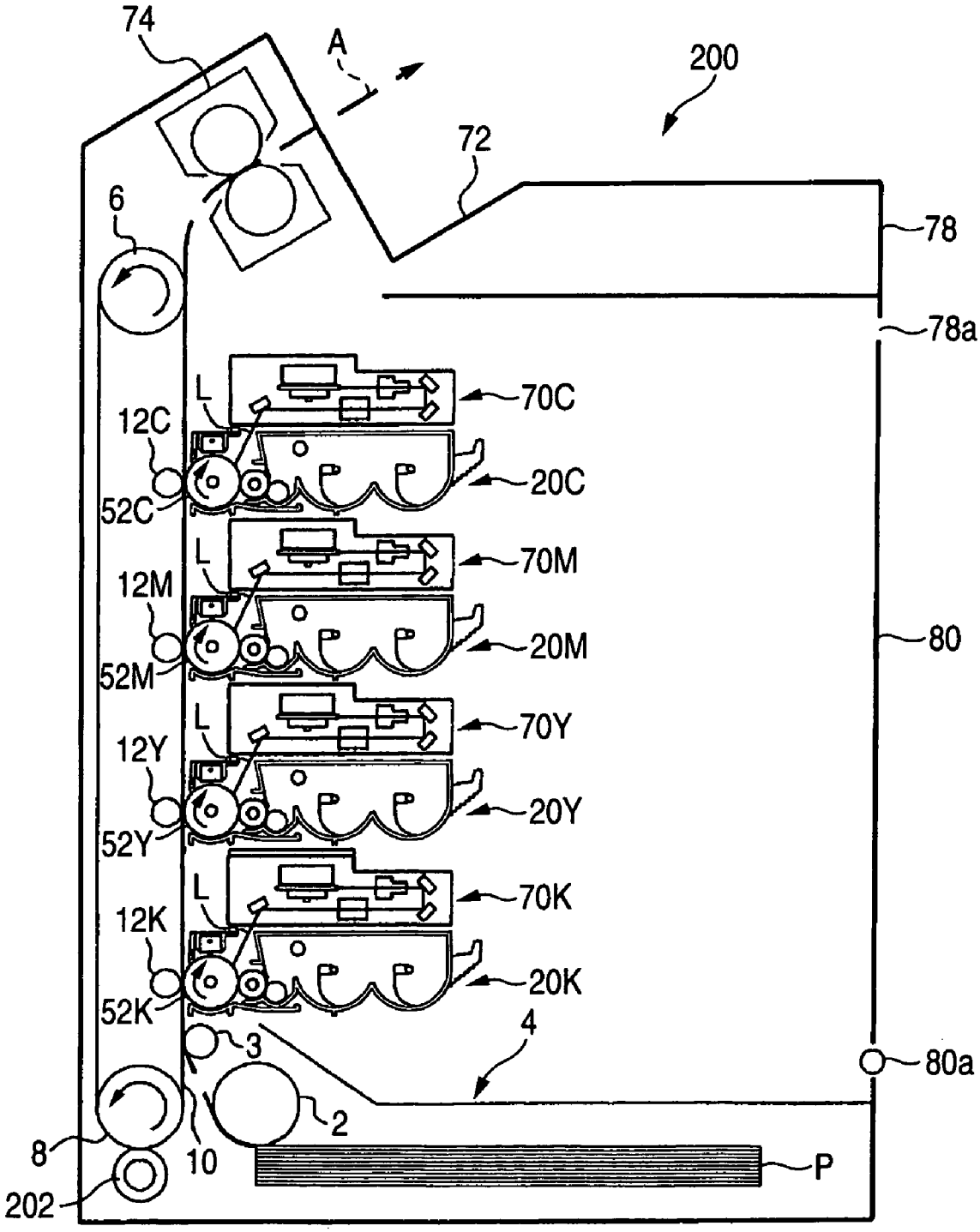
FIG. 7 is a schematic side cross-sectional view of a color laser printer according to a second embodiment of the invention.
Figure 8:
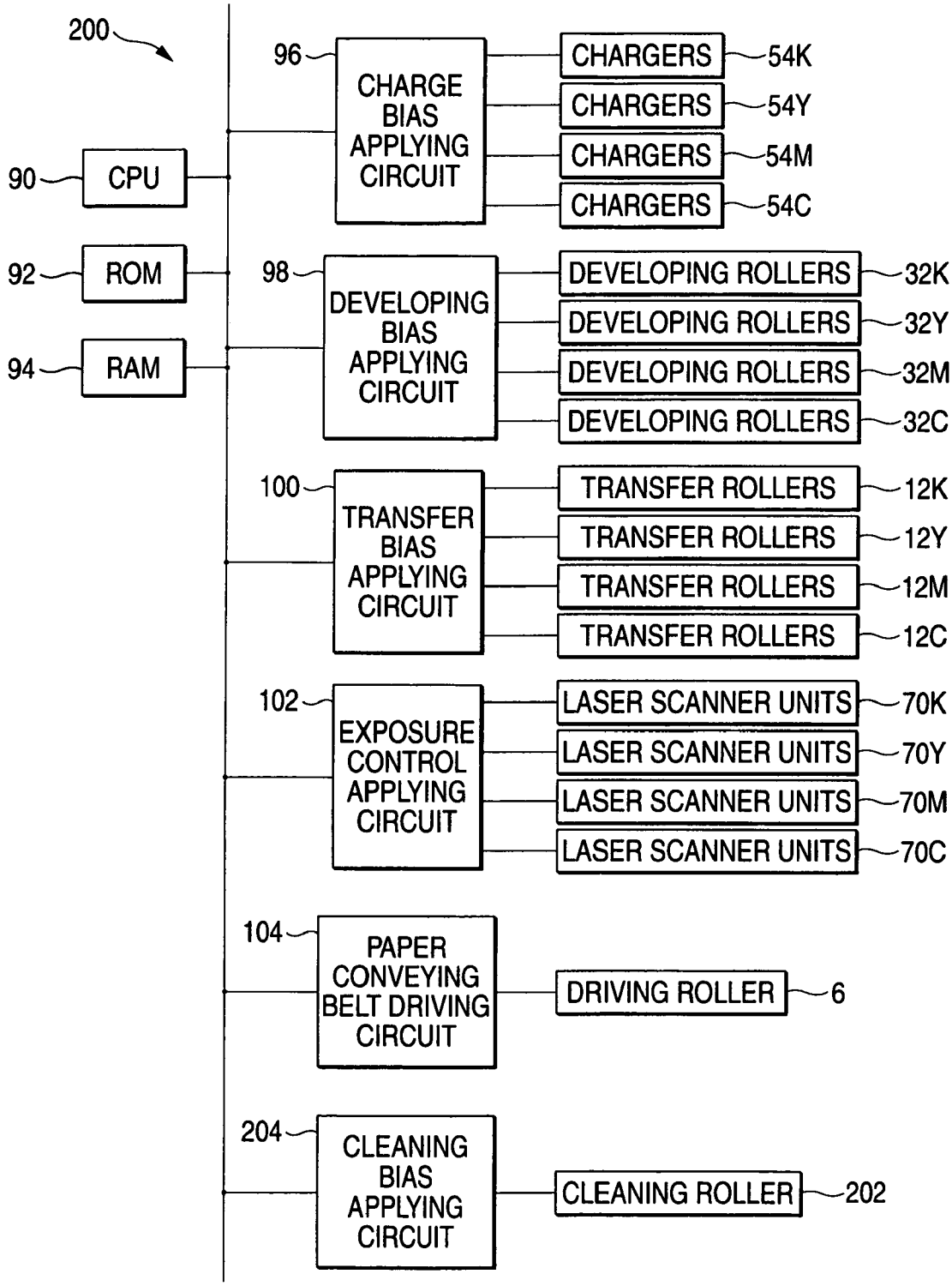
FIG. 8 is a block diagram representing an electrical configuration of the color laser printer according to the second embodiment.
Figure 9:
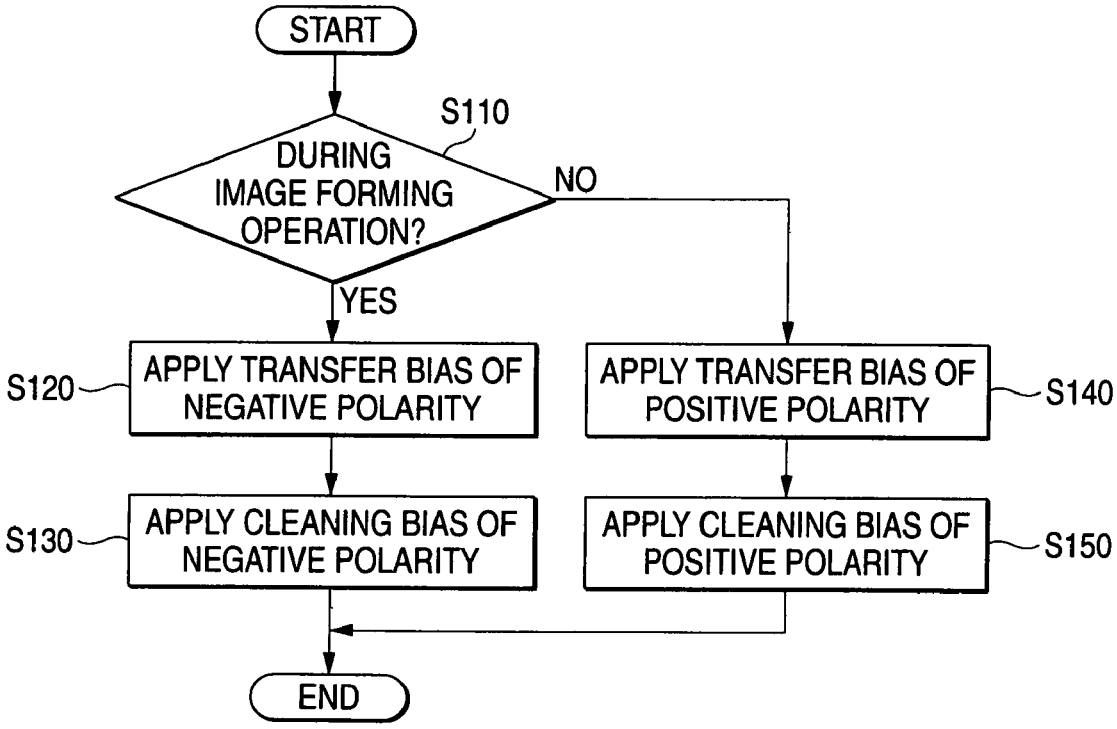
FIG. 9 is a flowchart representing a control process for a transfer roller and a cleaning bias.

Referring now to FIGS. 7 through 9, a color laser printer 200 according to a second embodiment of the invention will be described.

As shown in FIG. 7, the color laser printer 200 of the second embodiment, unlike the color laser printer 1 (shown in FIG. 1) of the first embodiment, includes a cleaning roller 202, instead of the belt charger 76, and correspondingly, a cleaning bias applying circuit 204, instead of the belt charge bias applying circuit 106 (shown in FIG. 6), as shown in FIG. 8. Parts the same as those in the first embodiment are denoted by the same reference numerals as those in the first embodiment, and detailed description of the parts will be omitted hereinbelow.

As shown in FIG. 7, the cleaning roller 202 in contact with the sheet conveying roller 10 is supported rotatably, following the driving of the sheet conveying belt 10. Also, a cleaning bias is applied to the cleaning roller 202 by the cleaning bias applying circuit 204, as shown in FIG. 8.

The operation of the color laser printer 200 will be described hereinbelow. The printing operation of the color image on the sheet P and the retrieval operation of residual toner on the photosensitive drum 52K, 52Y, 52M and 52C are identical to the contents of the first embodiment, and therefore the description of the operation is not repeated.

[Retrieval Operation of Toner Adhering to the Sheet Conveying Belt 10]

In the color laser printer 200, when an image forming operation of forming the color image by transferring successively the toner images formed on the photographic 52K, 52Y, 52M and 52C onto the sheet P conveyed by the sheet conveying belt 10 is performed (S110: YES), a transfer bias of negative polarity is applied to the transfer roller 12K, 12Y, 12M and 12C by the transfer bias applying circuit 100 (S120), and a cleaning bias of negative polarity is applied to the cleaning roller 202 by the cleaning bias applying circuit 204 (S130), as shown in FIG. 9. Thereby, the toner images formed on the photosensitive drums 52K, 52Y, 52M and 52C are transferred onto the sheet P. Also, the toner adhering onto the sheet conveying belt 10 is adsorbed and temporarily retrieved by the cleaning roller 202.

On the other hand, when the image forming operation is not performed (S110: NO), a transfer bias of positive polarity is applied to the transfer roller 12K by the transfer bias applying circuit 100 (S140), and a cleaning bias of positive polarity is applied to the cleaning roller 202 by the cleaning bias applying circuit 204 (S150). Thereby, the toner temporarily retrieved in the cleaning roller 202 is moved from the cleaning roller 202 onto the sheet conveying belt 10, and further moved onto the photosensitive drum 52K under the action of the transfer roller 12K, and retrieved into the developing unit 30K, as described above.

In the color laser printer 200 of the second embodiment, the cleaning roller 202 with steps S130 and S150 functions as retrieval restoring unit, and the transfer bias applying unit 100 with steps S120 and S140 functions as bias applying unit.

As described above, the color laser printer 200 of the second embodiment can provide the same advantages as listed as (a) to (j) in the first embodiment.

Figure 10:
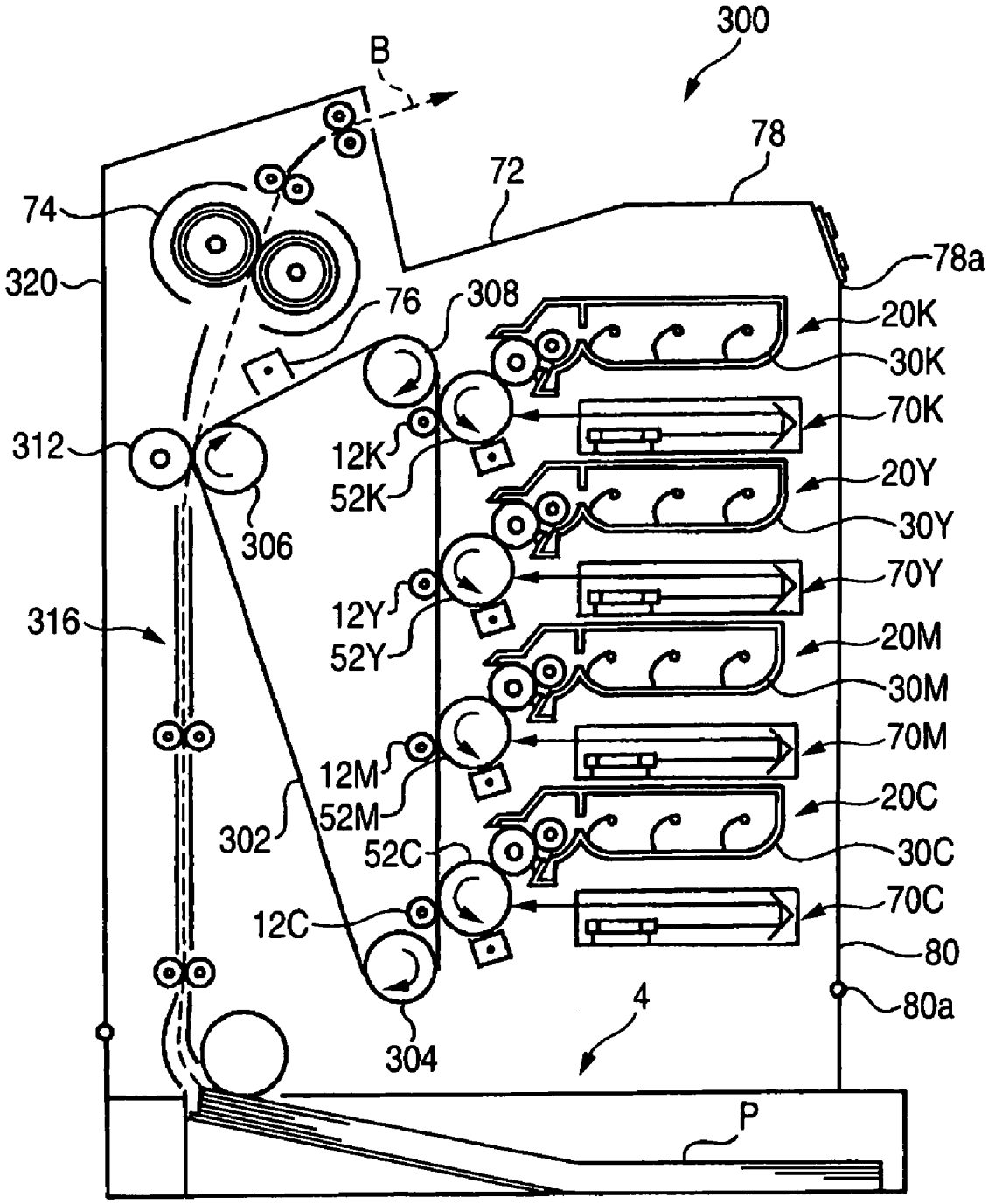
FIG. 10 is a schematic side cross-sectional view of a color laser printer according to a third embodiment of the invention.
Figure 11:
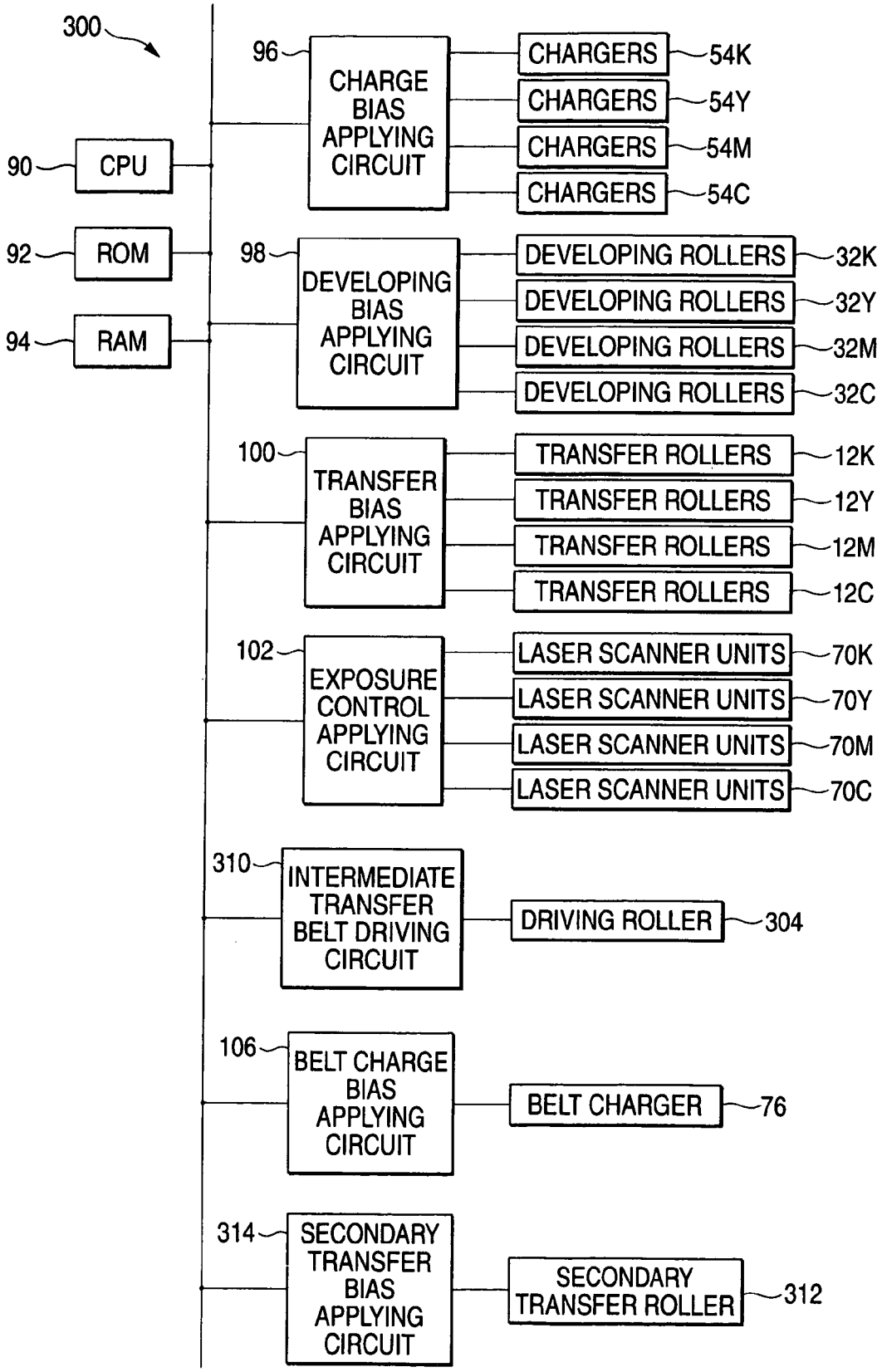
FIG. 11 is a block diagram representing an electrical configuration of the color laser printer according to the third embodiment.
Figure 12:
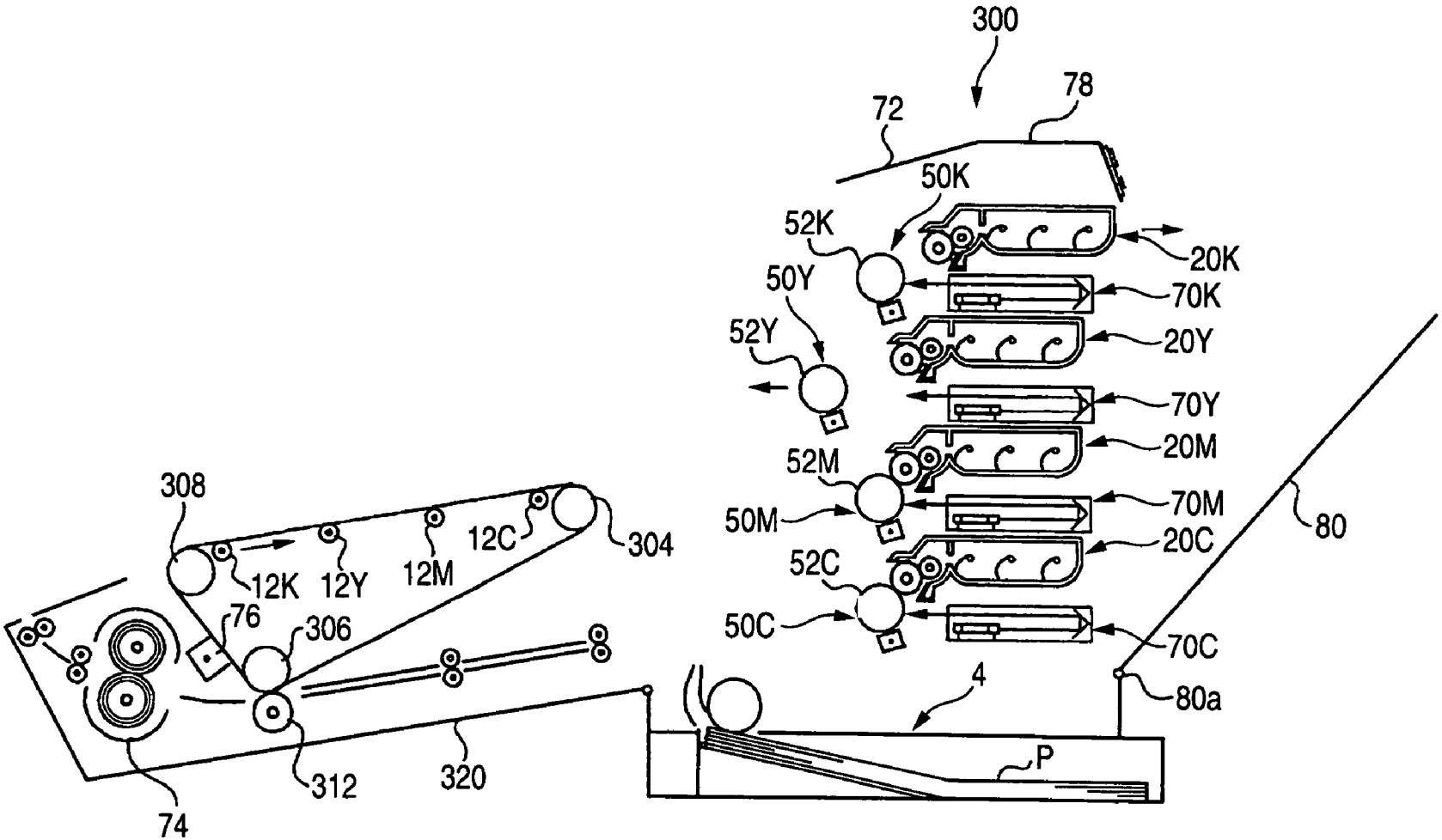
FIG. 12 is a schematic side cross-sectional view of the color laser printer according to the third embodiment in a state where a closing door is opened.

Referring now to FIGS. 10 through 12, a color laser printer 300 according to a third embodiment of the invention will be described hereinbelow.

In the color laser printer 300 of the third embodiment as shown in FIG. 10, the toner images on the photosensitive drums 52K, 52Y, 52M and 52C are once transferred onto the intermediate transfer belt 302, and then the toner images on the intermediate transfer belt 302 are transferred onto the sheet P, whereas the toner images on the photosensitive drums 52K, 52Y, 52M and 52C are directly transferred onto the sheet P conveyed by the sheet conveying belt 10 in the color laser printer 1 (shown in FIG. 1) of the first embodiment. Parts the same as those in the first embodiment are denoted by the same reference numerals as those in the first embodiment, and detailed description of the parts will be omitted hereinbelow.

As shown in FIG. 10, the intermediate transfer belt 302 is looped around a driving roller 304, and the driven rollers 306 and 308. An intermediate transfer belt driving circuit 310 is provided to drive for rotation the intermediate transfer belt 302 by the driving roller 304, as shown in FIG. 11. Thereby, the intermediate transfer belt 302 is driven for rotation so that a portion facing the photosensitive drum 52K, 52Y, 52M and 52C may be moved downwards in the vertical direction.

Moreover, the color laser printer 300 is provided with a secondary transfer roller 312 being rotated in contact with the intermediate transfer belt 302 at a position opposite to a driven roller 306, as shown in FIG. 10. A secondary transfer bias applying circuit 314 for applying a transfer bias to the secondary transfer roller 312 is provided, as shown in FIG. 11.

The color laser printer 300 includes a closing door 320 on the opposite side of the closing door 80 in the main body cover 78. And the intermediate transfer belt 302 and the fixing unit 74 are supported inside the closing door 320, whereby the drum units 50K, 50Y, 50M and 50C of the process cartridges 20K, 20Y, 20M and 20C can be mounted or demounted in a state where the closing door 320 is opened, as shown in FIG. 12.

The operation of the color laser printer 300 will be described hereinbelow. The retrieval operation of residual toner on the photosensitive drum 52K, 52Y, 52M and 52C involves the same contents as described in the first embodiment, and therefore the description of the operation is not repeated.

[Printing Operation of Color Image on the Sheet P]

The operation up to forming the toner image on the surface of the photosensitive drum 52K, 52Y, 52M and 52C involves the same contents as described in the first embodiment.

In the color laser printer 300, the toner image carried on the surface of each photosensitive drum 52K, 52Y, 52M and 52C is transferred successively on the same area of the intermediate transfer belt 302 by each photosensitive drum 52K, 52Y, 52M and 52C, and each transfer roller 12K, 12Y, 12M and 12C to which a transfer bias of reverse polarity (negative polarity) to the toner image on each photosensitive drum 52K, 52Y, 52M and 52C is applied by the transfer bias applying circuit 100 (image forming operation). Herein, the toner image for each color is formed with a slight time difference in accordance with the moving speed of the intermediate transfer belt 302 and the distance between each photosensitive drum 52K, 52Y, 52M and 52C, and thereby transferred onto the intermediate belt 302 and superposed thereon to form a color image. The moving speed of the intermediate transfer belt 302 is set to have a speed difference of about 1% from the peripheral speed of the photosensitive drum 52K, 52M, 52M and 52C.

On the other hand, the sheet P is supplied to a conveyance passage 316 for conveying the sheet P from the sheet feeding portion 4, conveyed upwards, passed between the intermediate transfer belt 302 and the secondary transfer roller 312, and discharged via the fixing unit 74 into the sheet discharging portion 72, as indicated by the arrow B.

And the toner image transferred onto the intermediate transfer belt 302 is transferred onto the sheet P by the secondary transfer roller to which a transfer roller of negative polarity is applied by the secondary transfer bias applying circuit 314 (image transfer operation). Thereafter, the toner image transferred onto the sheet P is fixed on the sheet P by the fixing unit 74, and the sheet P is discharged into the sheet discharging portion 72.

[Retrieval Operation of Residual Toner onto the Intermediate Transfer Belt 302]

The toner (residual toner after transfer) remaining on the intermediate transfer belt 302 without being transferred onto the sheet P is uniformly charged negatively by the belt charger 76, to which a charge bias is applied by the belt charge bias applying circuit 106, adsorbed (electrically moved) by the photosensitive drum 52K in passing between the photosensitive drum 52K on the most upstream side in the conveyance direction of the sheet P and the transfer roller 12K, to which a transfer bias of negative polarity is applied, and retrieved into the housing 36K by the developing roller 32K, as described above.

Also, in the color laser printer 300, when it is determined that there is a large amount of residual toner after transfer on the intermediate transfer belt 302 as in the first embodiment, the operation mode of the printer 300 transits from a normal mode in which the residual toner after transfer on the intermediate transfer belt 302 is retrieved during the printing of the image onto the sheet P to a cleaning mode in which the residual toner after transfer on the intermediate transfer belt 302 is retrieved without printing the image on the sheet P. The operation contents are the same as described in the first embodiment.

In the color laser printer 300 of the third embodiment, the intermediate transfer belt 302 functions as an endless belt.

As described above, the color laser printer 300 of the third embodiment provides the same advantages as in the first embodiment. Particularly, in the color laser printer 300, the toner images are directly transferred from the photosensitive drums 52K, 52Y, 52M and 52C to the intermediate transfer belt 302, thereby bringing about the great advantage of removing the residual toner after transfer from the intermediate transfer belt.

Figure 13:
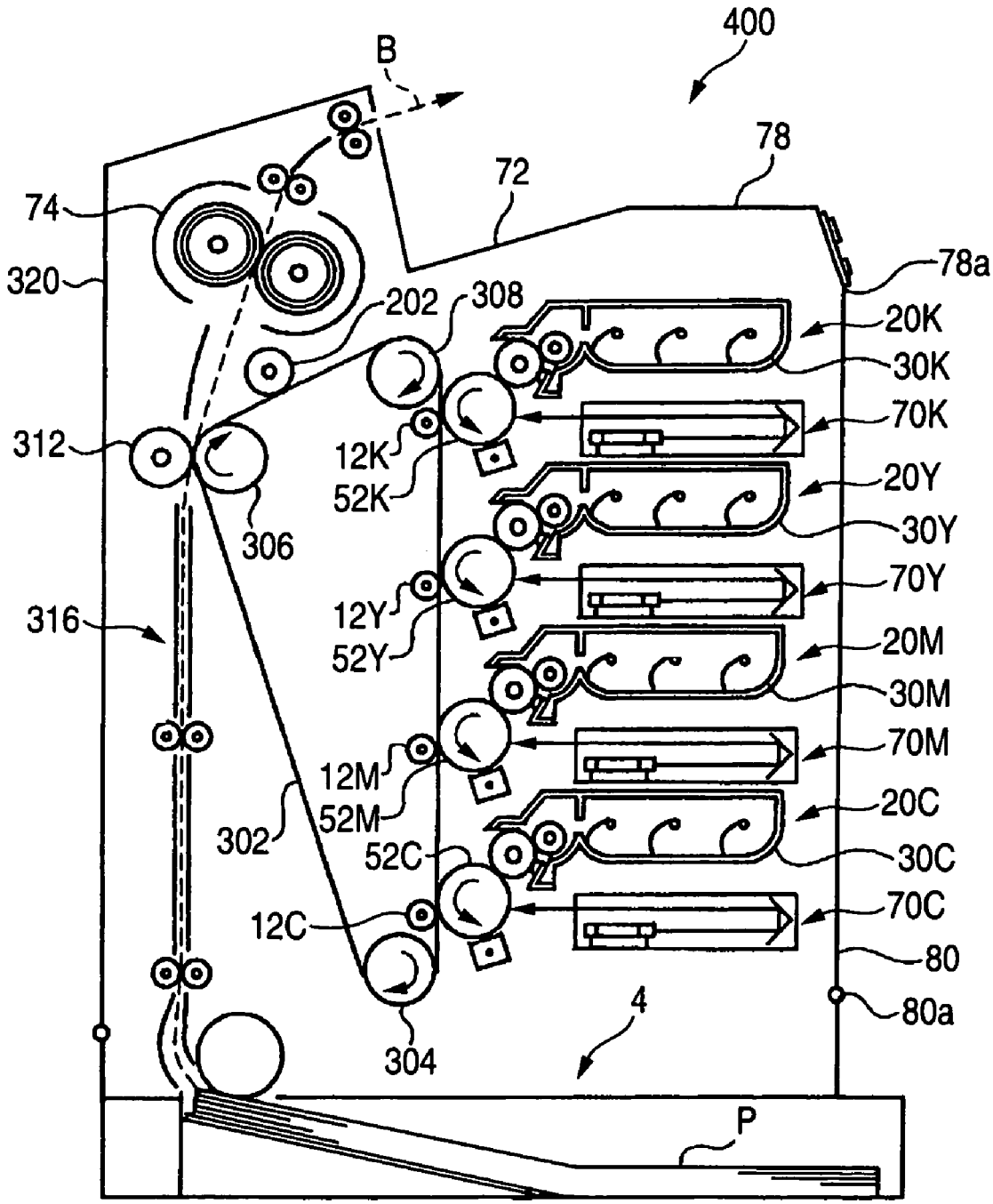
FIG. 13 is a schematic side cross-sectional view of a color laser printer according to a fourth embodiment of the invention.
Figure 14:
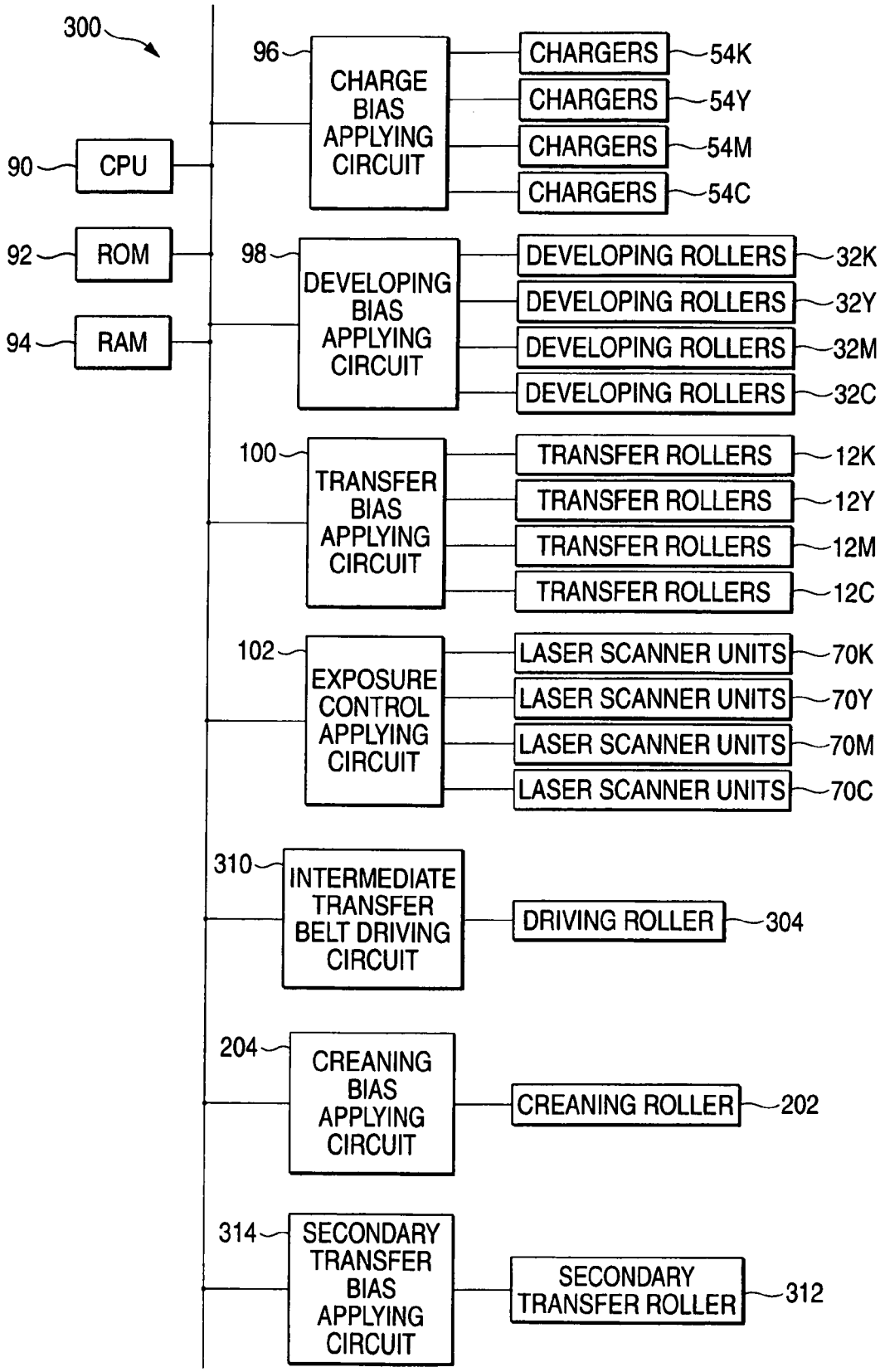
FIG. 14 is a block diagram representing an electrical configuration of the color laser printer according to the fourth embodiment.

Referring now to FIGS. 13 through 15, a color laser printer 400 according to a fourth embodiment of the invention will be described hereinbelow.

The color laser printer 400 of the fourth embodiment as shown in FIG. 13 has the cleaning roller 202 as employed in the second embodiment, instead of the belt charger 76, and correspondingly, the cleaning bias applying circuit 204 as employed in the second embodiment, instead of the belt charge bias applying circuit 106 (FIG. 11), as shown in FIG. 14, in contrast to the color laser printer 300 (FIG. 10) of the third embodiment. The parts of the color laser printer 400 of the fourth embodiment are designated by the same numerals as in the previous embodiments, and detailed descriptions of each of the parts is omitted herein.

The operation of the color laser printer 400 will be described below. The printing operation of the color image on the sheet P and the retrieval operation of residual toner on the photosensitive drums 52K, 52Y, 52M and 52C involve the same contents as described in the third embodiment, and therefore the description of the operation is not repeated.

[Retrieval Operation of Residual Toner on the Intermediate Transfer Belt 302]

The color laser printer 400 performs the operation in the same manner as described in the second embodiment.

That is, when an image forming operation of forming the color image by transferring successively the toner images formed on the photographic 52K, 52Y, 52M and 52C onto the intermediate transfer belt 302 is performed (S110: YES), a transfer bias of negative polarity is applied to the transfer roller 12K, 12Y, 12M and 12C by the transfer bias applying circuit 100 (S120), and a cleaning bias of negative polarity is applied to the cleaning roller 202 by the cleaning bias applying circuit 204 (S130), as shown in FIG. 9. Thereby, the toner images formed on the photosensitive drums 52K, 52Y, 52M and 52C are transferred onto the intermediate transfer belt 302. Also, the residual toner after transfer on the intermediate transfer belt 302 is adsorbed and temporarily retrieved by the cleaning roller 202.

On the other hand, when the image forming operation is not performed (S110: NO), a transfer bias of positive polarity is applied to the transfer roller 12K by the transfer bias applying circuit 100 (S140), and a cleaning bias of positive polarity is applied to the cleaning roller 202 by the cleaning bias applying circuit 204 (S150). Thereby, the toner held on the cleaning roller 202 is moved to the intermediate transfer belt 302, and further moved onto the photosensitive drum 52K under the action of the transfer roller 12K, and retrieved into the developing unit 30K.

As described above, the color laser printer 400 of the fourth embodiment can provide the same advantages as (a) through (j) in the first embodiment. And in the color laser printer 400, like the color laser printer 300 of the third embodiment, the toner images are directly transferred from the photosensitive drums 52K, 52Y, 52M and 52C to the intermediate transfer belt 302, bringing about the effect of removing the residual toner after transfer from the intermediate transfer belt 302.

The embodiments of the invention have been described above, but various modifications or variations may be made thereto.

For example, in the above embodiments, the invention is applied to the color laser printer, but besides may be also applied to the color facsimile apparatus and the color copying machine.

According to a first aspect of the present invention, there is provided an image forming apparatus including: an endless belt configured to be rotatably driven; a plurality of image carriers disposed in a moving direction of the endless belt; a plurality of charging units provided for each of the plurality of image carriers respectively and configured to uniformly charge a surface of each of the image carrier; an exposing unit configured to expose the plurality of image carriers charged by the charging unit to form an electrostatic latent image on the plurality of image carriers; and a plurality of developing units provided for each of the plurality of image carriers respectively and configured to develop the electrostatic latent image on each of the image carrier with a developer of different color to form a developer image and to retrieve a residual developer on the image carrier, wherein the endless belt is configured to be transferred the developer images formed on each of the plurality of image carriers thereon to form a color image, and transfers the color image onto a recording medium, and wherein the developing unit provided at a most upstream position with respect to the moving direction of the endless belt forms the developer image with a developer of black color, and is configured to retrieve a residual developer on the endless belt.

In the image forming apparatus configured as above, the residual developer on each image carrier is retrieved by each developing unit. Also, the residual developer on the endless belt is retrieved by the developing unit corresponding to the image carrier on the most upstream side. Herein, the residual developer on the endless belt contains different color developers, but the developing unit corresponding to the image carrier on the most upstream side forms the developer image with the black developer, with less influence by mixture of the other color developers.

Therefore, it is unnecessary to provide the container for collecting the waste developer, whereby the apparatus is made smaller. Particularly, the residual developer on the endless belt is passed from the endless belt via the image carrier to the developing unit, without need for providing the special conveying member for conveying the residual developer on the endless belt to the developing unit, whereby the apparatus is prevented from being increased in size.

In the image forming apparatus according to the first aspect of the present invention, the endless belt is employed as the intermediate transfer belt. However, the endless belt may be employed as a recording medium conveying belt.

That is, instead of the image forming operation and the image transfer operation performed by the image forming apparatus described above, the image forming apparatus according to a second aspect of the present invention performs the image forming operation in which the developer images formed on the plurality of image carriers are transferred in succession onto the recording medium conveyed by the endless belt to form a color image. The image forming apparatus according to the second aspect of the present invention brings about the same advantages as described in connection with the image forming apparatus according to the first aspect of the present invention.

Also, in the image forming apparatus according to the first and the second aspect of the invention, to electrically move the developer on the endless belt to the image carrier on the most upstream side, the structure of an image forming apparatus according to a third aspect of the invention may be taken.

That is, the image forming apparatus according to the third aspect of the invention further includes a developer charging unit for charging the developer on the endless belt in a reverse polarity to the charging polarity of the developer. With this structure, the developer on the endless belt can be removed during the image forming operation.

Also, with this structure, when the endless belt is driven at the initial operation of turning on the power, or before or after exposure with the exposing unit for the image forming operation, the developer is removed from the endless belt, whereby the start-up time required to be ready for the image forming operation is shortened.

Herein, when a large amount of developer may be adherent to the endless belt, the developer on the endless belt is desirably removed more effectively.

Thus, an image forming apparatus according to a fourth aspect of the invention has, as the operation modes of the image forming apparatus, a normal mode in which the developer on the endless belt is charged by the developer charging unit and electrically moved to the image carrier on the most upstream side in a state where the image carrier on the most upstream side is exposed to light by the exposing unit, and a cleaning mode in which the developer on the endless belt is charged by the developer charging unit and electrically moved to the image carrier on the most upstream side in a state where the image carrier on the most upstream side is not exposed to light by the exposing unit. With this structure, when a small amount of developer may remain on the endless belt, the operation mode of the image forming apparatus is set to the normal mode to remove the developer on the endless belt during the image forming operation, while when a large amount of developer may remain on the endless belt, the operation mode of the image forming apparatus is set to the cleaning mode to remove the developer on the endless belt over the entire face of the image carrier effectively.

In the image forming apparatus according to the first and the second aspect of the invention, to electrically move the developer on the endless belt to the image carrier on the most upstream side, the structure according to a fifth aspect of the invention may be taken.

That is, an image forming apparatus according to the fifth aspect of the invention further includes a retrieval restoring unit for temporarily retrieving the developer on the endless belt and restoring the retrieved developer onto the endless belt. With this structure, the developer on the endless belt is moved to the image carrier. Moreover, with this structure, when there is a large amount of developer on the endless belt, the developer is temporarily retrieved from the endless belt by the retrieval restoring unit, whereby the residual developer is prevented from having influence on the image quality or contaminating the recording medium.

An image forming apparatus according to a sixth aspect of the invention further includes a bias generating unit that applies a bias generating a potential difference to move the developer on the endless belt to the image carrier With this structure, the developer restored to the endless belt is easily moved to the image carrier.

In an image forming apparatus according to a seventh aspect of the invention, the charging unit is disposed to be in non-contact with the image carrier. With this structure, the developer on the image carrier is prevented from adhering to the charging unit.

In an image forming apparatus according to an eighth aspect of the invention, the developing unit is removably provided on the image forming apparatus separately from the image carrier.

With this structure, when the developing unit is replaced because the amount of toner is small, it is unnecessary to replace the image carrier together, whereby the running cost of the apparatus is reduced. That is, in the case where the image carrier and the developing unit are integrally provided, if the developing unit is replaced, the image carrier must be replaced together.

Particularly, the image carrier for use in the tandem image forming apparatus is required to have a high precision, and leads to the high cost, because the transfer positions of plural developer units must be aligned. In addition, in this image forming apparatus, the adherent developer is retrieved in an area past the transfer position on the image carrier, without need for employing the blade for scraping the developer from the image carrier, whereby the life of the image carrier is lengthened, bringing about the great advantage that the developing unit is replaced separately from the image carrier.

In an image forming apparatus according to a ninth aspect of the invention, the developing unit is constituted in such a manner that a developer carrier for carrying the developer is in contact with the image carrier, an electrostatic image on the image carrier is developed with a developer carried by the developing carrier to form a developer image, and the residual developer adhering to an area past the transfer position on the image carrier is retrieved by the developer carrier. With this structure, the developer adhering to the area past the transfer position on the image carrier is retrieved efficiently by the developer carrier.

In an image forming apparatus according to a tenth aspect of the invention, the developing unit employs a polymerized toner as the developer. With this structure, since the polymerized toner has excellent fluidity, the amount of residual or adherent developer on the endless belt is decreased. Also, since the polymerized toner has excellent fluidity, the developer on the endless belt is electrically moved. Therefore, the developer is easily retrieved by the developer carrier. Herein, the reason of using the polymerized toner is that the developer adhering to the area past the transfer position on the image carrier is retrieved by the developing unit in the apparatus. That is, for example, if the developer adhering to the area past the transfer position on the image carrier is scraped by the blade, the powder toner needs to be employed, because the polymerized toner is difficult to scrape, so that the residual toner on the endless belt is increased.

In an image forming apparatus according to the invention, the developing unit includes developer supplying unit, in contact with the developer carrier for carrying the developer, for supplying the developer onto the developer carrier while charging the developer, and among a plurality of color developers for use in the plurality of developing units, the black developer is more chargeable than the other color developers. With this structure, among the developers retrieved in the developing unit corresponding to the image carrier on the most upstream side, the black developer is preferentially employed.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus, comprising:

an endless belt configured to be rotatably driven;

a plurality of image carriers disposed in a moving direction of the endless belt;

a plurality of charging units, a charging unit provided for each image carrier of the plurality of image carriers and configured to uniformly charge a surface of an associated image carrier;

a plurality of exposing units, each exposing unit configured to expose an associated image carrier of the plurality of image carriers charged by the associated charging unit to form an electrostatic latent image on each image carrier of the plurality of image carriers; and a plurality of developing units, a developing unit provided for each image carrier of the plurality of image carriers and configured to develop the electrostatic latent image on an associated image carrier with a developer of different color to form a developer image, wherein the endless belt is configured to transfer the developer image formed on each image carrier of the plurality of image carriers to form a color image, the developing unit provided at a most upstream position with respect to the moving direction of the endless belt forms the developer image with a developer of black color, and the each developing unit is configured to be separable from the associated image carrier and detachable from the image forming apparatus, each developing unit comprising a developer supplying unit disposed to be in contact with a developer carrier and supplies onto the developer carrier while charging the developer, and the developer of black color contains more charge control agent than developers of other colors so that the developer of black color is more chargeable than the developers of other colors.

2. The image forming apparatus as claimed in claim 1, wherein the developing unit provided at the most upstream position retrieves residual developer on the endless belt by electrically moving the residual developer.

3. The image forming apparatus as claimed in claim 1, further comprising a developer charging unit that charges the developer on the endless belt in a reverse polarity to a charging polarity of the developer.

4. The image forming apparatus as claimed in claim 3, wherein the image forming apparatus operates in a plurality of modes including:

a normal mode in which the developer on the endless belt is charged by the developer charging unit and electrically moved to the image carrier provided at the most upstream position in a state where the image carrier provided at the most upstream position is exposed to light by the exposing unit; and a cleaning mode in which the developer on the endless belt is charged by the developer charging unit and electrically moved to the image carrier provided at the most upstream position in a state where the image carrier provided at the most upstream position is not exposed to light by the exposing unit.

5. The image forming apparatus as claimed in claim 1, further comprising a retrieval restoring unit that temporarily retrieves the developer on the endless belt and restores the retrieved developer onto the endless belt.

6. The image forming apparatus as claimed in claim 5, further comprising a bias generating unit that applies a bias generating a potential difference to move the developer on the endless belt to the image carrier.

7. The image forming apparatus as claimed in claim 1, wherein the charging unit is disposed to be in non-contact with the associated image carrier.

8. The image forming apparatus as claimed in claim 1, wherein the developing unit comprises a developer carrier disposed to be in contact with the image carrier and carries the developer for forming the developer image by developing an electrostatic image on the image carrier, and the developer carrier is configured to retrieve residual developer on the image carrier.

9. The image forming apparatus as claimed in claim 1, wherein the developing unit employs a polymerized toner as the developer.

10. The image forming apparatus according to claim 1, wherein the black developer contains more charge control agent than the other color developers.

11. The image forming apparatus according to claim 1, wherein the plurality of developing units are arranged vertically and the developing unit for the black developer is at an uppermost position.

12. The image forming apparatus according to claim 1, wherein each developing unit comprises a developer storing unit having shape elongated in a horizontal direction.

13. An image forming apparatus, comprising:

an endless belt configured to be rotatably driven and to convey a recording medium;

a plurality of image carriers disposed in a moving direction of the endless belt;

a plurality of charging units, a charging unit provided for each image carrier of the plurality of image carriers and configured to uniformly charge a surface of an associated image carrier;

a plurality of exposing units, each exposing unit configured to expose an associated image carrier of the plurality of image carriers charged by the associated charging unit to form an electrostatic latent image on an associated image carrier of the plurality of image carriers; and a plurality of developing units, a developing unit provided for each image carrier of the plurality of image carriers and configured to develop the electrostatic latent image on an associated image carrier with a developer of different color to form a developer image, wherein each of the plurality of image carriers transfer the developer images onto the recording medium to form a color image, and the developing unit provided at a most upstream position with respect to the moving direction of the endless belt forms the developer image with a developer of black color, each developing unit comprising a developer supplying unit disposed to be in contact with a developer carrier and supplies the developer onto the developer carrier while charging the developer, and the developer of black color contains more charge control agent than developers of other colors so that the developer of black color is more chargeable than the developers of other colors.

14. The image forming apparatus as claimed in claim 13, wherein the developing unit provided at the most upstream position retrieves the developer on the endless belt by electrically moving residual developer.

15. The image forming apparatus as claimed in claim 13, further comprising a developer charging unit that charges the developer on the endless belt in a reverse polarity to a charging polarity of the developer.

16. The image forming apparatus as claimed in claim 15, wherein the image forming apparatus operates in a plurality of modes including:

a normal mode in which the developer on the endless belt is charged by the developer charging unit and electrically moved to the image carrier provided at the most upstream position in a state where the image carrier provided at the most upstream position is exposed to light by the exposing unit; and a cleaning mode in which the developer on the endless belt is charged by the developer charging unit and electrically moved to the image carrier provided at the most upstream position in a state where the image carrier provided at the most upstream position is not exposed to light by the exposing unit.

17. The image forming apparatus as claimed in claim 13, wherein the charging unit is disposed to be in non-contact with the associated image carrier.

18. The image forming apparatus as claimed in claim 13, wherein the developing unit is configured to be separable from the associated image carrier and detachable from the image forming apparatus.

19. The image forming apparatus as claimed in claim 13, wherein the developing unit comprises a developer carrier disposed to be in contact with the image carrier and carries the developer for forming the developer image by developing an electrostatic image on the image carrier, and the developer carrier is configured to retrieve the residual developer on the image carrier.

20. The image forming apparatus as claimed in claim 13, wherein the developing unit employs a polymerized toner as the developer.

21. The image forming apparatus according to claim 13, wherein the black developer contains more charge control agent than the other color developers.

22. The image forming apparatus according to claim 13, wherein the plurality of developing units are arranged vertically and the developing unit for the black developer is at an uppermost position.

23. The image forming apparatus according to claim 13, wherein each developing unit comprises a developer storing unit having shape elongated in a horizontal direction.

* * * * *